US007535466B2

(12) United States Patent
Sampsell et al.

(10) Patent No.: US 7,535,466 B2
(45) Date of Patent: May 19, 2009

(54) SYSTEM WITH SERVER BASED CONTROL OF CLIENT DEVICE DISPLAY FEATURES

(75) Inventors: Jeffrey B. Sampsell, San Jose, CA (US); Karen Tyger, Foster City, CA (US); Mithran Mathew, Mountain View, CA (US)

(73) Assignee: IDC, LLC, Pleasanton, CA (US)

( * ) Notice: Subject to any disclaimer, the term of this patent is extended or adjusted under 35 U.S.C. 154(b) by 719 days.

(21) Appl. No.: 11/097,509

(22) Filed: Apr. 1, 2005

(65) Prior Publication Data

US 2006/0066504 A1 Mar. 30, 2006

Related U.S. Application Data

(60) Provisional application No. 60/614,360, filed on Sep. 27, 2004.

(51) Int. Cl.
*G09G 5/00* (2006.01)

(52) U.S. Cl. ..... 345/204; 345/48; 345/63; 345/84; 345/85; 345/690

(58) Field of Classification Search ..... 345/204, 345/48, 63, 84–85, 690
See application file for complete search history.

(56) References Cited

U.S. PATENT DOCUMENTS

| | | | |
|---|---|---|---|
| 2,534,846 | A | 12/1950 | Ambrose et al. |
| 3,184,600 | A | 5/1965 | Potter |
| 3,371,345 | A | 2/1968 | Lewis |
| 3,410,363 | A | 11/1968 | Schwartz |
| 3,439,973 | A | 4/1969 | Paul et al. |

(Continued)

FOREIGN PATENT DOCUMENTS

| | | | |
|---|---|---|---|
| EP | 0261897 | A2 | 3/1988 |

(Continued)

OTHER PUBLICATIONS

Mark W. Miles, "MEMS-based interferometric modulator for display applications," Proceedings of SPIE, vol. 3876, Aug. 1999, pp. 20-28.

(Continued)

*Primary Examiner*—Richard Hjerpe
*Assistant Examiner*—Leonid Shapiro
(74) *Attorney, Agent, or Firm*—Knobbe Martens Olson & Bear LLP

(57) ABSTRACT

Systems and methods of controlling client display modes are disclosed. In one embodiment, an electronic device includes an array of interferometric modulators, and an array driver for the array of interferometric modulators. The array driver is configured to receive video data which at least a portion of is in an interlaced format, to identify a portion of the video data as interlaced format, and to render the identified video data in an interlaced format on the array of interferometric modulators. In another embodiment, a method of displaying information on a bi-stable display includes receiving video data at a device having an interlaced mode of displaying data and a non-interlaced mode of displaying data, identifying at least a portion of the video data as interlaced format, and displaying the interlaced video data on the bi-stable display. In some embodiments the bi-stable display can be an array of interferometric modulators.

6 Claims, 14 Drawing Sheets

U.S. PATENT DOCUMENTS 3,443,854 A 5/1969 Weiss
3,653,741 A 4/1972 Marks
3,656,836 A 4/1972 de Cremoux et al.
3,746,785 A 7/1973 Te Velde
3,813,265 A 5/1974 Marks
3,955,880 A 5/1976 Lierke
3,972,040 A 7/1976 Hilsum et al.
4,099,854 A 7/1978 Decker et al.
4,228,437 A 10/1980 Shelton
4,347,983 A 9/1982 Bodai
4,377,324 A 3/1983 Durand et al.
4,389,096 A 6/1983 Hori et al.
4,392,711 A 7/1983 Moraw et al.
4,403,248 A 9/1983 te Velde
4,441,791 A 4/1984 Hornbeck
4,445,050 A 4/1984 Marks
4,459,182 A 7/1984 Te Velde
4,482,213 A 11/1984 Piliavin et al.
4,500,171 A 2/1985 Penz et al.
4,519,676 A 5/1985 te Velde
4,531,126 A 7/1985 Sadones
4,566,935 A 1/1986 Hornbeck
4,571,603 A 2/1986 Hornbeck et al.
4,596,992 A 6/1986 Hornbeck
4,615,595 A 10/1986 Hornbeck
4,662,746 A 5/1987 Hornbeck
4,663,083 A 5/1987 Marks
4,681,403 A 7/1987 te Velde et al.
4,710,732 A 12/1987 Hornbeck
4,748,366 A 5/1988 Taylor
4,786,128 A 11/1988 Birnbach
4,790,635 A 12/1988 Apsley
4,798,437 A 1/1989 Rediker et al.
4,856,863 A 8/1989 Sampsell et al.
4,857,978 A 8/1989 Goldburt et al.
4,859,060 A 8/1989 Katagiri et al.
4,900,136 A 2/1990 Goldburt et al.
4,900,395 A 2/1990 Syverson et al.
4,954,789 A 9/1990 Sampsell
4,956,619 A 9/1990 Hornbeck
4,965,562 A 10/1990 Verhulst
4,977,009 A 12/1990 Anderson et al.
4,982,184 A 1/1991 Kirkwood
5,018,256 A 5/1991 Hornbeck
5,022,745 A 6/1991 Zahowski et al.
5,028,939 A 7/1991 Hornbeck et al.
5,037,173 A 8/1991 Sampsell et al.
5,044,736 A 9/1991 Jaskie et al.
5,061,049 A 10/1991 Hornbeck
5,075,796 A 12/1991 Schildkraut et al.
5,078,479 A 1/1992 Vuilleumier
5,079,544 A 1/1992 DeMond et al.
5,083,857 A 1/1992 Hornbeck
5,096,279 A 3/1992 Hornbeck et al.
5,099,353 A 3/1992 Hornbeck
5,124,834 A 6/1992 Cusano et al.
5,126,836 A 6/1992 Um
5,142,405 A 8/1992 Hornbeck
5,142,414 A 8/1992 Koehler
5,148,157 A 9/1992 Florence
5,153,771 A 10/1992 Link et al.
5,162,787 A 11/1992 Thompson et al.
5,168,406 A 12/1992 Nelson
5,170,156 A 12/1992 DeMond et al.
5,172,262 A 12/1992 Hornbeck
5,179,274 A 1/1993 Sampsell
5,185,660 A 2/1993 Um
5,192,395 A 3/1993 Boysel et al.
5,192,946 A 3/1993 Thompson et al.
5,206,629 A 4/1993 DeMond et al.
5,214,419 A 5/1993 DeMond et al.
5,214,420 A 5/1993 Thompson et al.
5,216,537 A 6/1993 Hornbeck
5,226,099 A 7/1993 Mignardi et al.
5,228,013 A 7/1993 Bik
5,231,532 A 7/1993 Magel et al.
5,233,385 A 8/1993 Sampsell
5,233,456 A 8/1993 Nelson
5,233,459 A 8/1993 Bozler et al.
5,244,707 A 9/1993 Shores
5,254,980 A 10/1993 Hendrix et al.
5,272,473 A 12/1993 Thompson et al.
5,278,652 A 1/1994 Urbanus et al.
5,280,277 A 1/1994 Hornbeck
5,287,096 A 2/1994 Thompson et al.
5,293,272 A 3/1994 Jannson et al.
5,296,950 A 3/1994 Lin et al.
5,304,419 A 4/1994 Shores
5,305,640 A 4/1994 Boysel et al.
5,311,360 A 5/1994 Bloom et al.
5,312,513 A 5/1994 Florence et al.
5,323,002 A 6/1994 Sampsell et al.
5,324,683 A 6/1994 Fitch et al.
5,325,116 A 6/1994 Sampsell
5,326,430 A 7/1994 Cronin et al.
5,327,286 A 7/1994 Sampsell et al.
5,331,454 A 7/1994 Hornbeck
5,339,116 A 8/1994 Urbanus et al.
5,353,114 A 10/1994 Hansen
5,358,601 A 10/1994 Cathey
5,365,283 A 11/1994 Doherty et al.
5,381,253 A 1/1995 Sharp et al.
5,401,983 A 3/1995 Jokerst et al.
5,411,769 A 5/1995 Hornbeck
5,444,566 A 8/1995 Gale et al.
5,446,479 A 8/1995 Thompson et al.
5,448,314 A 9/1995 Heimbuch et al.
5,450,205 A 9/1995 Sawin et al.
5,452,024 A 9/1995 Sampsell
5,454,906 A 10/1995 Baker et al.
5,457,493 A 10/1995 Leddy et al.
5,457,566 A 10/1995 Sampsell et al.
5,459,602 A 10/1995 Sampsell
5,459,610 A 10/1995 Bloom et al.
5,461,411 A 10/1995 Florence et al.
5,474,865 A 12/1995 Vasudev
5,489,952 A 2/1996 Gove et al.
5,497,172 A 3/1996 Doherty et al.
5,497,197 A 3/1996 Gove et al.
5,499,037 A 3/1996 Nakagawa et al.
5,499,062 A 3/1996 Urbanus
5,500,635 A 3/1996 Mott
5,500,761 A 3/1996 Goossen et al.
5,506,597 A 4/1996 Thompson et al.
5,515,076 A 5/1996 Thompson et al.
5,517,347 A 5/1996 Sampsell
5,523,803 A 6/1996 Urbanus et al.
5,526,051 A 6/1996 Gove et al.
5,526,172 A 6/1996 Kanack
5,526,327 A 6/1996 Cordova, Jr.
5,526,688 A 6/1996 Boysel et al.
5,530,240 A 6/1996 Larson et al.
5,535,047 A 7/1996 Hornbeck
5,546,104 A 8/1996 Kuga
5,548,301 A 8/1996 Kornher et al.
5,548,329 A * 8/1996 Klatt ..... 348/164
5,550,373 A 8/1996 Cole et al.
5,551,293 A 9/1996 Boysel et al.
5,552,568 A 9/1996 Onodaka et al.
5,552,924 A 9/1996 Tregilgas
5,552,925 A 9/1996 Worley
5,559,358 A 9/1996 Burns et al.
5,563,398 A 10/1996 Sampsell
5,567,334 A 10/1996 Baker et al.

5,570,135 A 10/1996 Gove et al.
5,579,149 A 11/1996 Moret et al.
5,580,144 A 12/1996 Stroomer
5,581,272 A 12/1996 Conner et al.
5,583,688 A 12/1996 Hornbeck
5,589,852 A 12/1996 Thompson et al.
5,591,379 A 1/1997 Shores
5,597,736 A 1/1997 Sampsell
5,600,383 A 2/1997 Hornbeck
5,602,671 A 2/1997 Hornbeck
5,606,441 A 2/1997 Florence et al.
5,608,468 A 3/1997 Gove et al.
5,610,438 A 3/1997 Wallace et al.
5,610,624 A 3/1997 Bhuva
5,610,625 A 3/1997 Sampsell
5,619,059 A 4/1997 Li et al.
5,619,365 A 4/1997 Rhoades et al.
5,619,366 A 4/1997 Rhoads et al.
5,629,790 A 5/1997 Neukermans et al.
5,636,052 A 6/1997 Arney et al.
5,636,185 A 6/1997 Brewer et al.
5,646,768 A 7/1997 Kaeiyama
5,650,881 A 7/1997 Hornbeck
5,654,741 A 8/1997 Sampsell et al.
5,657,099 A 8/1997 Doherty et al.
5,659,374 A 8/1997 Gale, Jr. et al.
5,665,997 A 9/1997 Weaver et al.
5,673,139 A 9/1997 Johnson
5,683,591 A 11/1997 Offenberg
5,699,074 A 12/1997 Sutherland et al.
5,703,710 A 12/1997 Brinkman et al.
5,710,656 A 1/1998 Goosen
5,726,480 A 3/1998 Pister
5,739,945 A 4/1998 Tayebati
5,745,193 A 4/1998 Urbanus et al.
5,745,281 A 4/1998 Yi et al.
5,771,116 A 6/1998 Miller et al.
5,784,190 A 7/1998 Worley
5,784,212 A 7/1998 Hornbeck
5,793,504 A 8/1998 Stoll
5,808,780 A 9/1998 McDonald
5,815,141 A 9/1998 Phares
5,818,095 A 10/1998 Sampsell
5,825,528 A 10/1998 Goosen
5,835,255 A 11/1998 Miles
5,842,088 A 11/1998 Thompson
5,909,205 A 6/1999 Furuhashi et al.
5,912,758 A 6/1999 Knipe et al.
5,936,668 A 8/1999 Sawanobori et al.
5,943,158 A 8/1999 Ford et al.
5,945,980 A 8/1999 Moissev et al.
5,986,796 A 11/1999 Miles
6,028,690 A 2/2000 Carter et al.
6,038,056 A 3/2000 Florence et al.
6,040,937 A 3/2000 Miles
6,049,317 A 4/2000 Thompson et al.
6,055,090 A 4/2000 Miles
6,061,075 A 5/2000 Nelson et al.
6,099,132 A 8/2000 Kaeriyama
6,100,872 A 8/2000 Aratani et al.
6,113,239 A 9/2000 Sampsell et al.
6,147,790 A 11/2000 Meier et al.
6,160,833 A 12/2000 Floyd et al.
6,180,428 B1 1/2001 Peeters et al.
6,201,633 B1 3/2001 Peeters et al.
6,222,511 B1 4/2001 Stoller et al.
6,232,936 B1 5/2001 Gove et al.
6,242,989 B1 6/2001 Barber et al.
6,243,149 B1 6/2001 Swanson et al.
6,275,220 B1 8/2001 Nitta
6,282,010 B1 8/2001 Sulzbach et al.
6,295,048 B1 9/2001 Ward et al.
6,295,154 B1 9/2001 Laor et al.
6,304,297 B1 10/2001 Swan
6,307,194 B1 10/2001 Fitzgibbons et al.
6,323,982 B1 11/2001 Hornbeck
6,339,417 B1 1/2002 Quanrud
6,395,863 B2 5/2002 Geaghan
6,424,094 B1 7/2002 Feldman
6,447,126 B1 9/2002 Hornbeck
6,465,355 B1 10/2002 Horsley
6,466,354 B1 10/2002 Gudeman
6,466,358 B2 10/2002 Tew
6,473,072 B1 10/2002 Comiskey et al.
6,473,274 B1 10/2002 Maimone et al.
6,480,177 B2 11/2002 Doherty et al.
6,496,122 B2 12/2002 Sampsell
6,522,794 B1 * 2/2003 Bischel et al. ..... 385/4
6,545,335 B1 4/2003 Chua et al.
6,548,908 B2 4/2003 Chua et al.
6,549,195 B2 4/2003 Hikida et al.
6,549,338 B1 4/2003 Wolverton et al.
6,552,840 B2 4/2003 Knipe
6,574,033 B1 6/2003 Chui et al.
6,589,625 B1 7/2003 Kothari et al.
6,600,201 B2 7/2003 Hartwell et al.
6,606,175 B1 8/2003 Sampsell et al.
6,625,047 B2 9/2003 Coleman, Jr.
6,630,786 B2 10/2003 Cummings et al.
6,632,698 B2 10/2003 Ives
6,643,069 B2 11/2003 Dewald
6,650,455 B2 11/2003 Miles
6,666,561 B1 12/2003 Blakley
6,674,090 B1 1/2004 Chua et al.
6,674,562 B1 1/2004 Miles et al.
6,710,908 B2 3/2004 Miles et al.
6,741,377 B2 5/2004 Miles
6,741,384 B1 5/2004 Martin et al.
6,741,503 B1 5/2004 Farris et al.
6,747,785 B2 6/2004 Chen et al.
6,747,800 B1 6/2004 Lin
6,762,873 B1 7/2004 Coker et al.
6,775,174 B2 8/2004 Huffman et al.
6,778,155 B2 8/2004 Doherty et al.
6,794,119 B2 9/2004 Miles
6,811,267 B1 11/2004 Allen et al.
6,819,469 B1 11/2004 Koba
6,822,628 B2 11/2004 Dunphy et al.
6,829,132 B2 12/2004 Martin et al.
6,853,129 B1 2/2005 Cummings et al.
6,855,610 B2 2/2005 Tung et al.
6,859,218 B1 2/2005 Luman et al.
6,861,277 B1 3/2005 Monroe et al.
6,862,022 B2 3/2005 Slupe
6,862,029 B1 3/2005 D'Souza et al.
6,867,896 B2 3/2005 Miles
6,870,581 B2 3/2005 Li et al.
6,870,654 B2 3/2005 Lin et al.
6,882,458 B2 4/2005 Lin et al.
6,882,461 B1 4/2005 Tsai et al.
6,912,022 B2 6/2005 Lin et al.
6,952,303 B2 10/2005 Lin et al.
6,958,847 B2 10/2005 Lin
7,123,216 B1 10/2006 Miles
7,138,984 B1 11/2006 Miles
7,280,265 B2 10/2007 Miles
2001/0003487 A1 6/2001 Miles
2001/0040538 A1 11/2001 Quanrud
2001/0050666 A1 12/2001 Huang et al.
2002/0012159 A1 1/2002 Tew
2002/0015215 A1 2/2002 Miles
2002/0024711 A1 2/2002 Miles
2002/0041264 A1 4/2002 Quanrud
2002/0054424 A1 5/2002 Miles
2002/0075555 A1 6/2002 Miles
2002/0126364 A1 9/2002 Miles 2002/0149828 A1 10/2002 Miles
2002/0171610 A1 11/2002 Siwinski et al.
2002/0175284 A1 11/2002 Vilain
2002/0181208 A1 12/2002 Credelle et al.
2002/0186209 A1 12/2002 Cok
2003/0004272 A1 1/2003 Power
2003/0043157 A1 3/2003 Miles
2003/0072070 A1 4/2003 Miles
2003/0107805 A1 6/2003 Street
2003/0117382 A1 6/2003 Pawlowski et al.
2003/0122773 A1 7/2003 Washio
2003/0128197 A1 7/2003 Turner et al.
2003/0141453 A1 7/2003 Reed et al.
2003/0173504 A1 9/2003 Cole et al.
2003/0202264 A1 10/2003 Weber et al.
2003/0202265 A1 10/2003 Reboa et al.
2003/0202266 A1 10/2003 Ring et al.
2004/0024580 A1* 2/2004 Salmonsen et al. ..... 703/27
2004/0027324 A1 2/2004 Furuhashi et al.
2004/0051929 A1 3/2004 Sampsell et al.
2004/0058532 A1 3/2004 Miles et al.
2004/0080807 A1 4/2004 Chen et al.
2004/0125281 A1 7/2004 Lin et al.
2004/0145049 A1 7/2004 McKinnell et al.
2004/0145811 A1 7/2004 Lin et al.
2004/0147056 A1 7/2004 McKinnell et al.
2004/0147198 A1 7/2004 Lin et al.
2004/0150939 A1 8/2004 Huff
2004/0160143 A1 8/2004 Shreeve et al.
2004/0174583 A1 9/2004 Chen et al.
2004/0175577 A1 9/2004 Lin et al.
2004/0179281 A1 9/2004 Reboa
2004/0207897 A1 10/2004 Lin
2004/0209192 A1 10/2004 Lin et al.
2004/0209195 A1 10/2004 Lin
2004/0212026 A1 10/2004 Van Brocklin et al.
2004/0217378 A1 11/2004 Martin et al.
2004/0217919 A1 11/2004 Pichl et al.
2004/0218251 A1 11/2004 Piehl et al.
2004/0218334 A1 11/2004 Martin et al.
2004/0218341 A1 11/2004 Martin et al.
2004/0227493 A1 11/2004 Van Brocklin et al.
2004/0240032 A1 12/2004 Miles
2004/0240138 A1 12/2004 Martin et al.
2004/0245588 A1 12/2004 Nikkel et al.
2004/0263944 A1 12/2004 Miles et al.
2005/0001828 A1 1/2005 Martin et al.
2005/0003667 A1 1/2005 Lin et al.
2005/0017177 A1 1/2005 Tai et al.
2005/0017942 A1 1/2005 Tsujino et al.
2005/0024557 A1 2/2005 Lin
2005/0035699 A1 2/2005 Tsai
2005/0036095 A1 2/2005 Yeh et al.
2005/0036192 A1 2/2005 Lin et al.
2005/0038950 A1 2/2005 Adelmann
2005/0042117 A1 2/2005 Lin
2005/0046922 A1 3/2005 Lin et al.
2005/0046948 A1 3/2005 Lin
2005/0057442 A1 3/2005 Way
2005/0068583 A1 3/2005 Gutkowski et al.
2005/0068605 A1 3/2005 Tsai
2005/0068606 A1 3/2005 Tsai
2005/0069209 A1 3/2005 Damera-Venkata et al.
2005/0078348 A1 4/2005 Lin
2005/0168849 A1 8/2005 Lin
2005/0195462 A1 9/2005 Lin
2005/0202649 A1 9/2005 Hung et al.
2005/0219272 A1 10/2005 Johnson et al.
2005/0253820 A1 11/2005 Horiuchi
2007/0132843 A1 6/2007 Miles

FOREIGN PATENT DOCUMENTS

| | | | |
|---|---|---|---|
| EP | 0 584 358 | | 3/1994 |
| EP | 0 602 623 | | 6/1994 |
| EP | 0608056 | A1 | 7/1994 |
| EP | 0667548 | | 8/1995 |
| EP | 0 725 380 | | 8/1996 |
| EP | 0986077 | A2 | 3/2000 |
| EP | 1067805 | A2 | 1/2001 |
| JP | 3109524 | A | 5/1991 |
| JP | 405275401 | | 10/1993 |
| JP | 10161630 | A | 6/1998 |
| TW | 157313 | | 5/1991 |
| WO | WO 94/29840 | A1 | 12/1994 |
| WO | WO 95/30924 | | 11/1995 |
| WO | WO 97/17628 | | 5/1997 |
| WO | WO 99/52006 | A2 | 10/1999 |
| WO | WO 99/52006 | A3 | 10/1999 |
| WO | WO 00/41161 | | 7/2000 |
| WO | WO 02/063602 | A1 | 8/2002 |
| WO | WO 03/007049 | A1 | 1/2003 |
| WO | WO 03/069413 | A1 | 8/2003 |
| WO | WO 03/073151 | A1 | 9/2003 |
| WO | WO 2004/006003 | A1 | 1/2004 |
| WO | WO 2004/026757 | A2 | 4/2004 |
| WO | WO 2004/066256 | | 8/2004 |
| WO | WO 2004/075526 | A2 | 9/2004 |
| WO | WO 2004/095409 | | 11/2004 |

OTHER PUBLICATIONS

Miles et al., 10.1: Digital PaperTM for reflective displays, SID 02 Digest, pp. 115-117, 2002.
NEC Corporation, MOS Integrated Circuit μPD16180, Preliminary Product Information, Apr. 2003.
Sato et al. A .9 m-pixel poly-Si TFT-LDC for HD and computer-data projectors, IEEE Transactions on Consumer Electronics, 41(4):1181-1187, Nov. 1995.
Akasaka, "Three-Dimensional IC Trends," Proceedings of IEEE, vol. 74, No. 12, pp. 1703-1714 (Dec. 1986).
Aratani et al., "Process and Design Considerations for Surface Micromachined Beams for a Tuneable Interferometer Array in Silicon," Proc. IEEE Microelectromechanical Workshop, Fort Lauderdale, FL, pp. 230-235 (Feb. 1993).
Aratani et al., "Surface Micromachined Tuneable Interferometer Array," Sensors and Actuators, pp. 17-23 (1994).
Billard, C.; "Tunable Capacitor," 5h Annual Review of LETI, Jun. 24, 2003, p. 7.
Chan et al., "Low-Actuation Voltage RF MEMS Shunt Switch With Cold Switching Lifetime of Seven Billion Cycles," Journal of Microelectromechanical Systems vol. 12, No. 5 (Oct. 2003).
Conner, "Hybrid Color Display Using Optical Interference Filter Array," SID Digest, pp. 577-580 (1993).
De Coster et al., "Variable RF MEMS Capacitors With Extended Tuning Range", IEEE International Solid-State Sensors and Actuators Conference, Boston, (Jun. 8-12, 2003).
Goossen et al., "Possible Display Applications of the Silicon Mechanical Anti-Reflection Switch," Society for Information Display (1994).
Goossen et al., "Silicon Modulator Based on Mechanically-Active Anti-Reflection Layer with 1Mbit/sec Capability for Fiber-in-the-Loop Applications," IEEE Photonics Technology Letters (Sep. 1994).
Gosch, "West Germany Grabs the Lead in X-Ray Lithography," Electronics, pp. 78-80 (Feb. 5, 1987).
Heines et al, "Bi-Stable Flat-Panel Display Based on a 180 [DEG.] Flipping Pixel", Conference: Displays IX: Displays for Defense Applications, (Apr. 2-5, 2002), Proceedings of the SPIE: The International Society for Optical Engineering, vol. 4712, pp. 327-335.
Howard et al., "Nanometer-Scale Fabrication Techniques," VLSI Electronics: Microstructure Science, vol. 5, pp. 145-153 and pp. 166-173 (1982).

Jackson, "Classical Electrodynamics," John Wiley & Sons Inc., pp. 568-573 date unknown.
Jerman et al., "A Miniature Fabry-Perot Interferometer with a Corrugated Silicon Diaphragm Support," IEEE Electron Devices Society (1988).
Johnson "Optical Scanners," Microwave Scanning Antennas, vol. 1, pp. 251-261 (1964).
Li, G.P. "On the design and Fabrication of Electrostatic RF MEMS Switches," Final Report 1999-00 for Micro Project 99-071, University of California, Irvine.
Light over Matter, Circle No. 36 (Jun. 1993).
Mait, "Design of Diffractive Optical Elements for Optical Signal Processing", IEEE Lasers and Electro-Optics Society Annual Meeting, pp. 59-60, (Nov. 15-18, 1993).
Newsbreaks, "Quantum-trench devices might operate at terahertz frequencies," Laser Focus World (May 1993).
Nieminen, Heikki, Ermolov, Vladimir; Silanto, Samuli; Nybergh, Kjell; Rhanen, Tapani; "Design of a Temperature-Stable RF MEM Capacitor," Institute of Electrical and Electronics Engineers (IEEE) Journal of Microelectromechanical Systems, vol. 13, No. 5, Oct. 2004, pp. 705-714.
Oliner et al., "Radiating Elements and Mutual Coupling," Microwave Scanning Antennas, vol. 2, p. 131-194 (1966).
Oz et al., "CMOS-Compatible RF-MEMS Tunable Capacitors", IEEE MTT-S International Microwave Symposium—IMS 2003, (Jun. 8-13, 2003).
Raley et al., "A Fabry-Perot Microinterferometer for Visible Wavelengths," IEEE Solid-State Sensor and Actuator Workshop, Hilton Head, SC (1992).
Solgaard et al., "Interference-Based Optical MEMS Filters", Optical 2004 Fiber Communication Conference, vol. 1, (Feb. 23-27, 2004).
Sperger et al., "High Performance Patterned All-Dielectric Interference Colour Filter for Display Applications," SID Digest, pp. 81-83 (1994).
Stone, "Radiation and Optics, An Introduction to the Classical Theory," McGraw-Hill, pp. 340-343 (1963).
Tan et al. "RF MEMS Simulation-High Isolation CPW Shunt Switches", Ansoft: Global Seminars: Delivering Performance (2003).
Vähä-Heikkilä et al. "Design of Capacitive RF MEMS Power Sensor" VTT Information Technology, (2002), available at <http://www.hut.fi/Units/Radio/URSI02/ursi_vaha-heikkila.pdf>.
Walker, et al., "Electron-beam-tunable Interference Filter Spatial Light Modulator," Optics Letters vol. 13, No. 5, pp. 345-347 (May 1988).
Wang et al., "Design and Fabrication of a Novel Two-Dimension MEMS-Based Tunable Capacitor", IEEE 2002 International Conference on Communications, Circuits and Systems and West Sino Expositions, vol. 2, pp. 1766-1769, (Jun. 29-Jul. 1, 2002).
Winton, John M., "A novel way to capture solar energy," Chemical Week, pp. 17-18 (May 15, 1985).
Wu, "Design of a Reflective Color LCD Using Optical Interference Reflectors," Asia Display '95, pp. 929-931 (Oct. 16, 1995).
Bouchaud, Jeremie; Wicht, Henning; "RF MEMES Analysis, Forecasts and Technology Review," Chip Unaxis, date unknown [online] retrieved from the Internet: <URL:http://semiconductors.unaxis.com/en/download/RF%20MEMS.pdf>.
Miles, "A New Reflective FPD Technology Using Interferometric Modulation," Society for Information Display '97 Digest, Session 7.3.
Pacheco et al. "Design of Low Actuation Voltage RF MEMS Switch" Radiation Laboratory and Center for Microsystems Department of Electrical Engineering and Computer Science University of Michigan, IEEE (2000) 0-7803-5687-X/00/.
Bass, "Handbook of Optics, vol. I, Fundamentals, Techniques, and Design, Second Edition," McGraw-Hill, Inc., New York, pp. 2.29-2.36 (1995).
Ibotson, et al. "Comparison of XeF2, and F-atom reactions with Si and Si02, Applied Physics Letters." vol. 44, No. 12, Jun. 1984. pp. 1129-1131.
Schnakenberg, et al. "THAHW Etchants for Silicon Micromachining." 1991 International Conference on Solid State Sensors and Actuators—Digest of Technical Papers. pp. 815-818.
Williams, et al. Etch Rates for Michromachining Processing—Journal of Microelectromechanical Systems. vol. 5 No. 4, Dec. 1996, pp. 256-269.
Winters, et al., "The Etching of Silicon with XeF2 Vapor." Applied Physics Letters, vol. 34. No. 1, Jan. 1979, pp. 70-73.
Austrian Search Report from U.S. Appl. No. 11/097,509, Jul. 14, 2005.
Austrian Search Report from U.S. Appl. No. 11/097,509, Jul. 29, 2005.
Austrian Search Report from U.S. Appl. No. 11/096,546, May 19, 2005.
Austrian Search Report from U.S. Appl. No. 11/140,560, Aug. 11, 2005.
Austrian Search Report from U.S. Appl. No. 11/066,724, May 13, 2005.
Austrian Search Report from U.S. Appl. No. 11/097,818, Jul. 14, 2005.
Austrian Search Report from U.S. Appl. No. 11/097,820, Jun. 29, 2005.

* cited by examiner

| | | Column Output Signals | |
|---|---|---|---|
| | | $+V_{bias}$ | $-V_{bias}$ |
| Row Output Signals | 0 | Stable | Stable |
| | $+\Delta V$ | Release | Actuate |
| | $-\Delta V$ | Actuate | Release |

SYSTEM WITH SERVER BASED CONTROL OF CLIENT DEVICE DISPLAY FEATURES

CROSS REFERENCE TO RELATED APPLICATIONS

This application claims priority to U.S. Provisional Application No. 60/614,360, titled "System With Server Based Control Of Client Display Features," filed Sep. 27, 2004, which is incorporated by reference, in its entirety. This application is related to U.S. application Ser. No. 11/097,819, titled "Controller And Driver Features For Bi-Stable Display," filed on even date herewith, U.S. Application No. 60/613,573, titled "System Having Different Update Rates For Different Portions Of A Partitioned Display," filed on even date herewith, U.S. application Ser. No. 11/096,547, titled "Method And System For Driving a Bi-Stable Display," filed on even date herewith, U.S. application Ser. No. 11/097,820, titled "System and Method of Transmitting Video Data," filed on even data herewith, and U.S. application Ser. No. 11/097,818, titled "System and Method of Transmitting Video Data," filed on even date herewith, all of which are incorporated herein by reference, in their entirety, and are presently assigned to the assignee of this application.

BACKGROUND

1. Field of the Invention

The field of the invention relates to microelectromechanical systems (MEMS).

2. Description of the Related Technology

Microelectromechanical systems (MEMS) include micro mechanical elements, actuators, and electronics. Micromechanical elements may be created using deposition, etching, and or other micromachining processes that etch away parts of substrates and/or deposited material layers or that add layers to form electrical and electromechanical devices. One type of MEMS device is called an interferometric modulator. An interferometric modulator may comprise a pair of conductive plates, one or both of which may be transparent and/or reflective in whole or part and capable of relative motion upon application of an appropriate electrical signal. One plate may comprise a stationary layer deposited on a substrate, the other plate may comprise a metallic membrane separated from the stationary layer by an air gap. Such devices have a wide range of applications, and it would be beneficial in the art to utilize and/or modify the characteristics of these types of devices so that their features can be exploited in improving existing products and creating new products that have not yet been developed.

SUMMARY OF CERTAIN EMBODIMENTS

The system, method, and devices of the invention each have several aspects, no single one of which is solely responsible for its desirable attributes. Without limiting the scope of this invention, its more prominent features will now be discussed briefly. After considering this discussion, and particularly after reading the section entitled "Detailed Description of Certain Embodiments" one will understand how the features of this invention provide advantages over other display devices.

A first embodiment includes a method of displaying information on a display having an array of interferometric modulators, comprising receiving video data at a device having an interlaced mode of displaying data and a non-interlaced mode of displaying data, identifying a portion of the video data as interlaced data, and displaying the interlaced data on a display of the device, the display having an array of interferometric modulators. In one aspect, the method further comprises partitioning the array of interferometric modulators into two or more regions, and displaying non-interlaced video data in the one or more regions of the display. In a second aspect, receiving video data comprises receiving video data at the device over a communications network. In a third aspect, receiving video data comprises receiving video data from an application running on the device. In a fourth aspect, identifying at the device a portion of the video data as interlaced data comprises using information received over the communications network. In a fifth aspect, displaying the interlaced data comprises displaying a first subset of rows of a video frame of interlaced data during a first time period, and displaying a second subset of rows of the video frame during a second time period while continuing to display the first subset of rows. In a sixth aspect, displaying the interlaced data comprises displaying a first half of a frame of interlaced data on the array during a first display refresh and displaying a second half of the frame of interlaced data on the array during a second display refresh. In a seventh aspect, displaying the second half of the frame of interlaced data during a refresh cycle comprises continuing to display the first half of the frame of interlaced data on the array during the second display refresh. In an eighth aspect, the array comprises pixels, and displaying the interlaced data on an array of interferometric modulators comprises updating only the pixels that have changed from a frame of previously displayed video data. In a ninth aspect, the array of interferometric modulators is partitioned into at least two regions, and the update rate of the two regions is different. In a tenth aspect, an update rate of the interlaced data is dynamically determined using the content of the interlaced data. In an eleventh aspect, an update rate of the interlaced data is determined using a user input value. In a twelfth aspect, an update rate of the interlaced data is determined using a frame skip count.

A second embodiment includes a system for displaying information on a display having an array of interferometric modulators, including means for receiving video data at a device having an interlaced mode of displaying data and a non-interlaced mode of displaying data, means for identifying at least a portion of the video data as interlaced data, and means for displaying the interlaced data on a display of the device having an array of interferometric modulators. A first aspect can also include means for defining a region of the interferometric modulators, and means for displaying the interlaced data in the defined region. In a second aspect, means for displaying the interlaced data can include means for displaying a subset of rows of a video frame in the interlaced data, and means for subsequently displaying the non-displayed subset of rows of a video frame in the interlaced data.

A third embodiment includes a system of displaying interlace data on an array of interferometric modulators, including a server configured to provide video data, wherein a portion of the video data is in an interlaced format, and a client device comprising an array of interferometric modulators, the client configured to receive the video data from said server, to identify the portion of the video data in an interlaced format, and to render the video data that is in an interlaced format on the array of interferometric modulators in an interlaced format. In one aspect, the client device can be configured to display the received interlaced video data on a first region of the array, and display received non-interlaced video data on a second region of the array.

A fourth embodiment includes an electronic device including an array of interferometric modulators, and an array driver for the array of interferometric modulators, the array driver configured to receive video data which includes data in interlaced format, to identify that portion of the video data in an interlaced format, and to render the identified video data in an interlaced format on the array of interferometric modulators. The array driver can be configured to display the received interlaced video data on a first region of the array, and display the non-interlaced video data on a second region of the array. In this embodiment, the array driver can selectively skip selected frames based upon a frame skip count.

A fifth embodiment includes an electronic device, including an array of interferometric modulators, and an array driver for the array of interferometric modulators, the array driver configured to display, depending on a selected mode, interlaced and non-interlaced video data. The array driver of this embodiment can display the interlaced video data in a selected region of the display, and the array driver can display the non-interlaced video data in a non-selected region of the display, and/or selectively skip selected frames based upon a frame skip count.

A sixth embodiment includes a method of displaying information on a display having an array of interferometric modulators, including determining at a server the characteristics of the display of a client device, selecting one or more display modes for the display of the client device based on the characteristics of the display, receiving video data at the client device over a communications network, and displaying the video data on the display using one or more of the selected display modes. In this embodiment, the method can also include partitioning the display into two or more regions and updating each region at its own update rate. One of the selected display modes can rip and hold and/or frame skip, a display mode that updates changes to the video data displayed on the array on an area-by-area basis, a display mode that updates the video data displayed on the array on a pixel-by-pixel basis, and/or a selected display mode that displays the video data in an interlaced format.

A seventh embodiment includes a method of displaying information on a display having an array of interferometric modulators, comprising receiving video data at a device having an interlaced mode of displaying data and a non-interlaced mode of displaying data, identifying a portion of the video data as interlaced data and a portion if the video data as non-interlaced data, and displaying the interlaced data on a first portion of a display of the device and displaying the non-interlaced data on a second portion of the display.

DETAILED DESCRIPTION OF CERTAIN EMBODIMENTS

Figure 1:
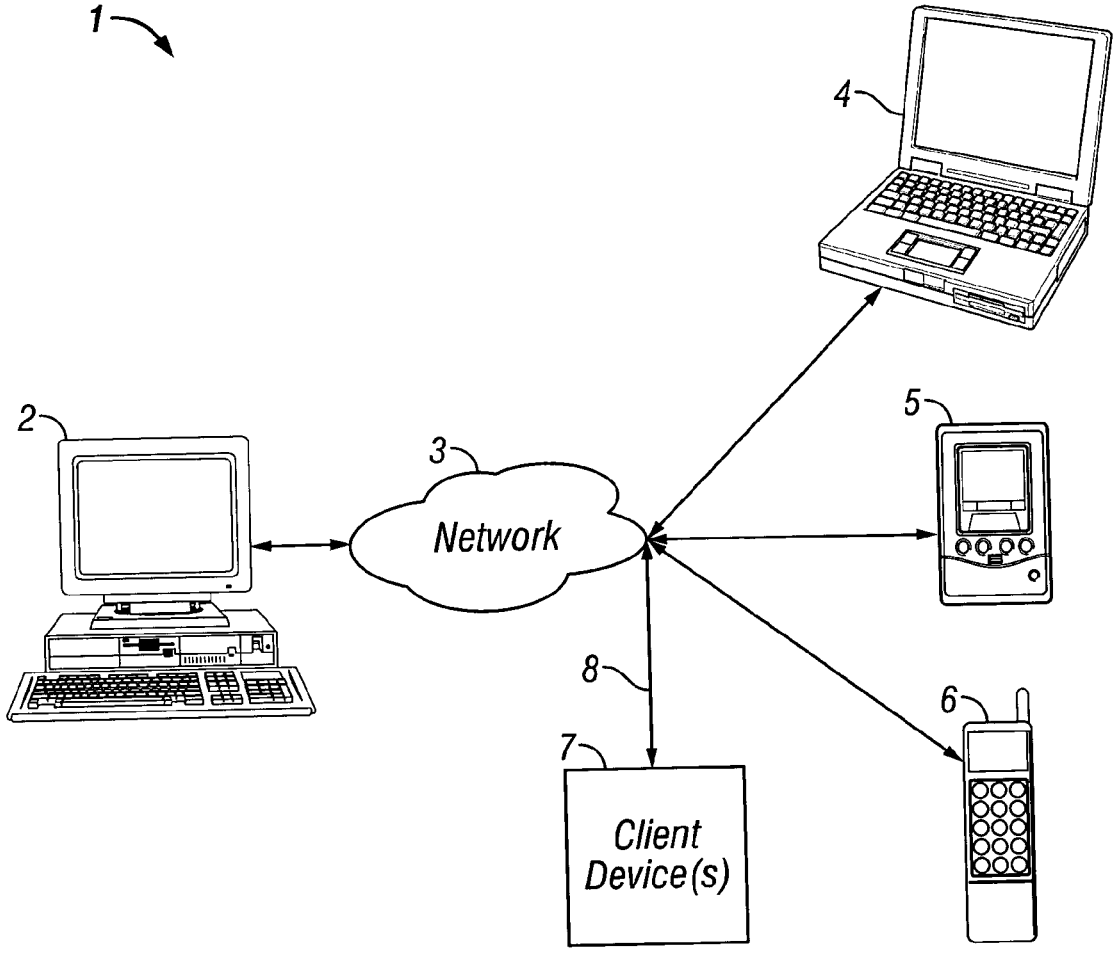
FIG. 1 illustrates a networked system of one embodiment.

The following detailed description is directed to certain specific embodiments. However, the invention can be embodied in a multitude of different ways. Reference in this specification to "one embodiment" or "an embodiment" means that a particular feature, structure, or characteristic described in connection with the embodiment is included in at least one embodiment. The appearances of the phrase "in one embodiment," "according to one embodiment," or "in some embodiments" in various places in the specification are not necessarily all referring to the same embodiment, nor are separate or alternative embodiments mutually exclusive of other embodiments. Moreover, various features are described which may be exhibited by some embodiments and not by others. Similarly, various requirements are described which may be requirements for some embodiments but not other embodiments.

In one embodiment, a display array on a device includes at least one driving circuit and an array of means, e.g., interferometric modulators, on which video data is displayed. Video data, as used herein, refers to any kind of displayable data, including pictures, graphics, and words, displayable in either static or dynamic images (for example, a series of video frames that when viewed give the appearance of movement, e.g., a continuous ever-changing display of stock quotes, a "video clip", or data indicating the occurrence of an event of action). Video data, as used herein, also refers to any kind of control data, including instructions on how the video data is to be processed (display mode), such as frame rate, and data format. The array is driven by the driving circuit to display video data.

Data is typically shown on a conventional display (e.g., a CRT, a LCD) in a single mode based on the characteristics of the display. A bi-stable display has the ability to display data for a significantly long period of time with very little energy consumption. Using a bi-stable display, for example, a display having an array of interferometric modulators, can allow innovative refresh and update modes that take advantage of not having to refresh the display unless the displayed data actually changes. One of the display modes of a bi-stable display, such as an interferometric modulator display, is "interlacing" mode. Typically, interlacing refers to a video data display methodology where a conventional display is updated or refreshed by alternately writing all the odd rows of a display for a first video data frame, and then in the next successive video data frame, writing all the even number rows for the next frame. For example, for a set of video data frames 1-6, the odd rows R1, R3, R5, and R7, etc., are written for frames 1, 3, and 5, and the even rows R2, R4, R6, etc., are written for frames 2, 4, and 6. Thus, in an interlaced format, halves of the total rows on the display are refreshed or updated in an alternating manner such that, for example, each odd or even row is refreshed or updated every other cycle. Because of the relatively frequent constant refreshing required with conventional displays, in many applications this raw interlaced data is processed into what is known as a progressive format which requires interpolating and merging the displayed interlaced lines of video data to form a suitable image for viewing. In contrast to a conventional display, an interferometric modulator display does not require constant refreshing to maintain an image. During a refresh cycle of interlaced data, where half of the rows are being refreshed or updated, the interferometric modulator display maintains the other half of the rows in their previously written state. This implementation can simplify the image processing circuits for the display and results in reduced power consumption in both the display and display circuitry.

In this description, reference is made to the drawings wherein like parts are designated with like numerals throughout. The invention may be implemented in any device that is configured to display an image, whether in motion (e.g., video) or stationary (e.g., still image), and whether textual or pictorial. More particularly, it is contemplated that the invention may be implemented in or associated with a variety of electronic devices such as, but not limited to, mobile telephones, wireless devices, personal data assistants (PDAs), hand-held or portable computers, GPS receivers/navigators, cameras, MP3 players, camcorders, game consoles, wrist watches, clocks, calculators, television monitors, flat panel displays, computer monitors, auto displays (e.g., odometer display, etc.), cockpit controls and/or displays, display of camera views (e.g., display of a rear view camera in a vehicle), electronic photographs, electronic billboards or signs, projectors, architectural structures, packaging, and aesthetic structures (e.g., display of images on a piece of jewelry). MEMS devices of similar structure to those described herein can also be used in non-display applications such as in electronic switching devices.

Spatial light modulators used for imaging applications come in many different forms. Transmissive liquid crystal display (LCD) modulators modulate light by controlling the twist and/or alignment of crystalline materials to block or pass light. Reflective spatial light modulators exploit various physical effects to control the amount of light reflected to the imaging surface. Examples of such reflective modulators include reflective LCDs, and digital micromirror devices.

Another example of a spatial light modulator is an interferometric modulator that modulates light by interference. Interferometric modulators are bi-stable display elements which employ a resonant optical cavity having at least one movable or deflectable wall. Constructive interference in the optical cavity determines the color of the viewable light emerging from the cavity. As the movable wall, typically comprised at least partially of metal, moves towards the stationary front surface of the cavity, the interference of light within the cavity is modulated, and that modulation affects the color of light emerging at the front surface of the modulator. The front surface is typically the surface where the image seen by the viewer appears, in the case where the interferometric modulator is a direct-view device.

FIG. 1 illustrates a networked system in accordance with one embodiment. A server 2, such as a Web server is operatively coupled to a network 3. The server 2 can correspond to a Web server, to a cell-phone server, to a wireless e-mail server, and the like. The network 3 can include wired networks, or wireless networks, such as WiFi networks, cell-phone networks, Bluetooth networks, and the like.

The network 3 can be operatively coupled to a broad variety of devices. Examples of devices that can be coupled to the network 3 include a computer such as a laptop computer 4, a personal digital assistant (PDA) 5, which can include wireless handheld devices such as the BlackBerry, a Palm Pilot, a Pocket PC, and the like, and a cell phone 6, such as a Web-enabled cell phone, Smartphone, and the like. Many other devices can be used, such as desk-top PCs, set-top boxes, digital media players, handheld PCs, Global Positioning System (GPS) navigation devices, automotive displays, or other stationary and mobile displays. For convenience of discussion all of these devices are collectively referred to herein as the client device 7.

Figure 2:
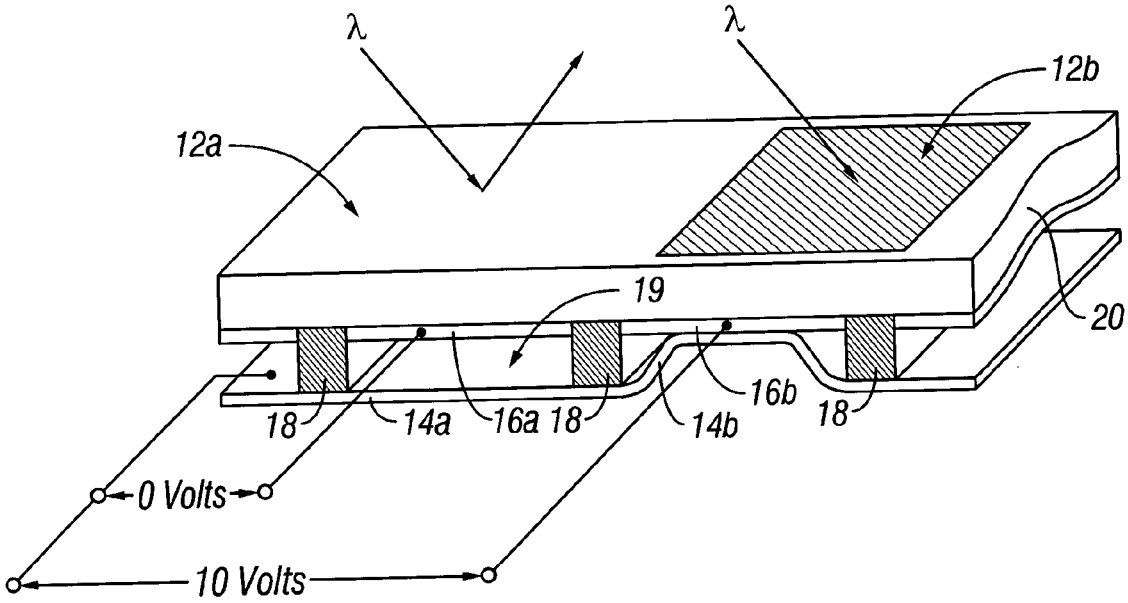
FIG. 2 is an isometric view depicting a portion of one embodiment of an interferometric modulator display array in which a movable reflective layer of a first interferometric modulator is in a released position and a movable reflective layer of a second interferometric modulator is in an actuated position.

One bi-stable display element embodiment comprising an interferometric MEMS display element is illustrated in FIG. 2. In these devices, the pixels are in either a bright or dark state. In the bright ("on" or "open") state, the display element reflects a large portion of incident visible light to a user. When in the dark ("off" or "closed") state, the display element reflects little incident visible light to the user. Depending on the embodiment, the light reflectance properties of the "on" and "offs" states may be reversed. MEMS pixels can be configured to reflect predominantly at selected colors, allowing for a color display in addition to black and white.

FIG. 2 is an isometric view depicting two adjacent pixels in a series of pixels of a visual display array, wherein each pixel comprises a MEMS interferometric modulator. In some embodiments, an interferometric modulator display array comprises a row/column array of these interferometric modulators. Each interferometric modulator includes a pair of reflective layers positioned at a variable and controllable distance from each other to form a resonant optical cavity with at least one variable dimension. In one embodiment, one of the reflective layers may be moved between two positions. In the first position, referred to herein as the released state, the movable layer is positioned at a relatively large distance from a fixed partially reflective layer. In the second position, the movable layer is positioned more closely adjacent to the partially reflective layer. Incident light that reflects from the two layers interferes constructively or destructively depending on the position of the movable reflective layer, producing either an overall reflective or non-reflective state for each pixel.

The depicted portion of the pixel array in FIG. 2 includes two adjacent interferometric modulators 12*a* and 12*b*. In the interferometric modulator 12*a* on the left, a movable and highly reflective layer 14*a* is illustrated in a released position at a predetermined distance from a fixed partially reflective layer 16*a*. In the interferometric modulator 12*b* on the right, the movable highly reflective layer 14*b* is illustrated in an actuated position adjacent to the fixed partially reflective layer 16*b*.

The partially reflective layers 16*a*, 16*b* are electrically conductive, partially transparent and fixed, and may be fabricated, for example, by depositing one or more layers each of chromium and indium-tin-oxide onto a transparent substrate 20. The layers are patterned into parallel strips, and may form row electrodes in a display device as described further below. The highly reflective layers 14*a*, 14*b* may be formed as a series of parallel strips of a deposited metal layer or layers (orthogonal to the row electrodes, partially reflective layers 16*a*, 16*b*) deposited on top of supports 18 and an intervening sacrificial material deposited between the supports 18. When the sacrificial material is etched away, the deformable metal layers are separated from the fixed metal layers by a defined air gap 19. A highly conductive and reflective material such as aluminum may be used for the deformable layers, and these strips may form column electrodes in a display device.

With no applied voltage, the air gap 19 remains between the layers 14*a*, 16*a* and the deformable layer is in a mechanically relaxed state as illustrated by the interferometric modulator 12*a* in FIG. 2. However, when a potential difference is applied to a selected row and column, the capacitor formed at the intersection of the row and column electrodes at the corresponding pixel becomes charged, and electrostatic forces pull the electrodes together. If the voltage is high enough, the movable layer is deformed and is forced against the fixed layer (a dielectric material which is not illustrated in this Figure may be deposited on the fixed layer to prevent shorting and control the separation distance) as illustrated by the interferometric modulator 12*b* on the right in FIG. 2. The behavior is the same regardless of the polarity of the applied potential difference. In this way, row/column actuation that can control the reflective vs. non-reflective interferometric modulator states is analogous in many ways to that used in conventional LCD and other display technologies.

FIGS. 3 through 5 illustrate an exemplary process and system for using an array of interferometric modulators in a display application. However, the process and system can also be applied to other displays, e.g., plasma, EL, OLED, STN LCD, and TFT LCD.

Currently, available flat panel display controllers and drivers have been designed to work almost exclusively with displays that need to be constantly refreshed. Thus, the image displayed on plasma, EL, OLED, STN LCD, and TFT LCD panels, for example, will disappear in a fraction of a second if not refreshed many times within a second. However, because interferometric modulators of the type described above have the ability to hold their state for a longer period of time without refresh, wherein the state of the interferometric modulators may be maintained in either of two states without refreshing, a display that uses interferometric modulators may be referred to as a bi-stable display. In one embodiment, the state of the pixel elements is maintained by applying a bias voltage, sometimes referred to as a latch voltage, to the one or more interferometric modulators that comprise the pixel element.

In general, a display device typically requires one or more controllers and driver circuits for proper control of the display device. Driver circuits, such as those used to drive LCD's, for example, may be bonded directly to, and situated along the edge of the display panel itself. Alternatively, driver circuits may be mounted on flexible circuit elements connecting the display panel (at its edge) to the rest of an electronic system. In either case, the drivers are typically located at the interface of the display panel and the remainder of the electronic system.

Figure 3A:
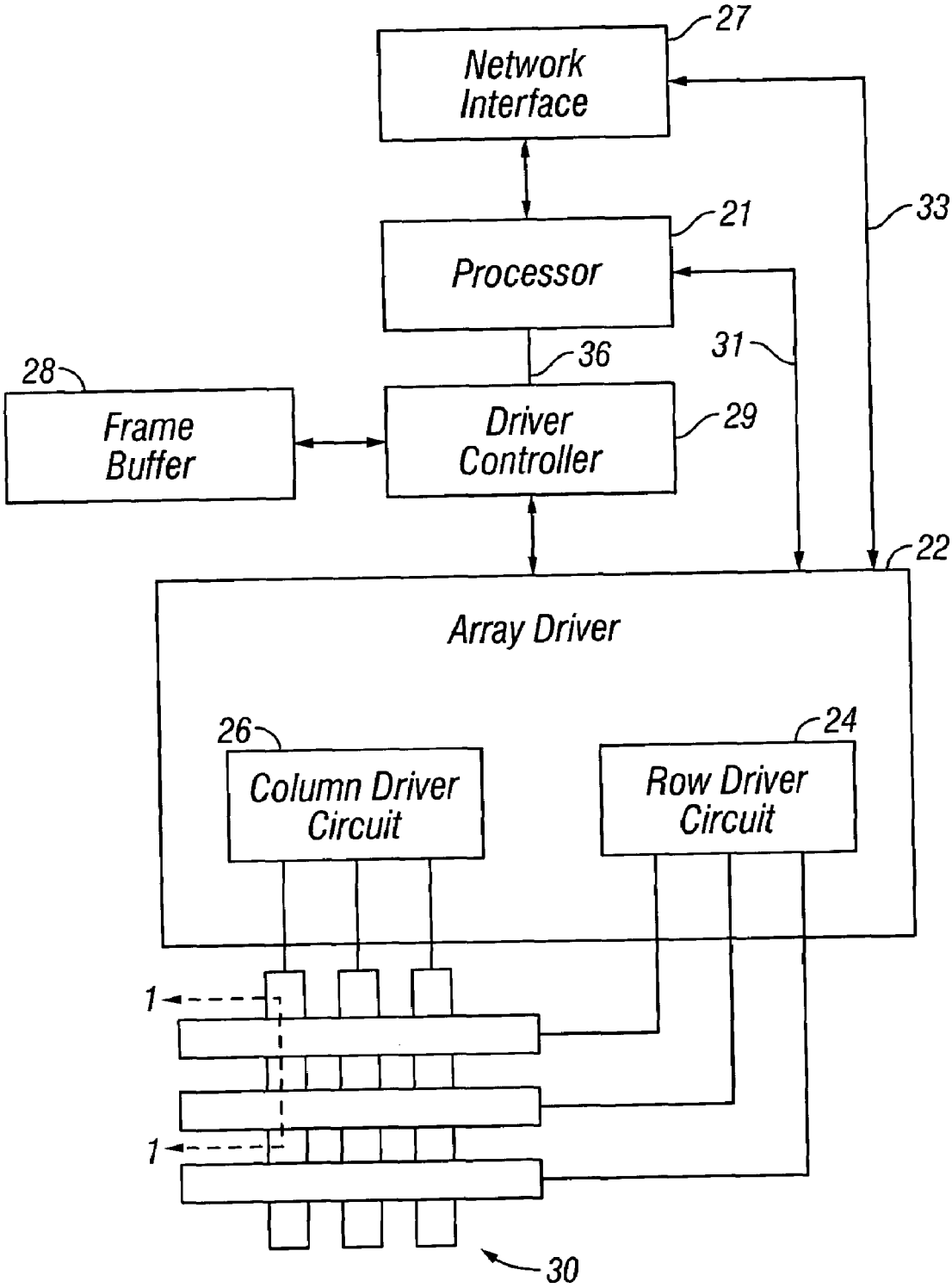
FIG. 3A is a system block diagram illustrating one embodiment of an electronic device incorporating a 3×3 interferometric modulator display array.

FIG. 3A is a system block diagram illustrating some embodiments of an electronic device that can incorporate various aspects. In the exemplary embodiment, the electronic device includes a processor 21 which may be any general purpose single- or multi-chip microprocessor such as an ARM, Pentium®, Pentium II®, Pentium III®, Pentium IV®, Pentium® Pro, an 8051, a MIPS®, a Power PC®, an ALPHA®, or any special purpose microprocessor such as a digital signal processor, microcontroller, or a programmable gate array. As is conventional in the art, the processor 21 may be configured to execute one or more software modules. In addition to executing an operating system, the processor may be configured to execute one or more software applications, including a web browser, a telephone application, an email program, or any other software application.

FIG. 3A illustrates an embodiment of electronic device that includes a network interface 27 connected to a processor 21 and, according to some embodiments, the network interface can be connected to an array driver 22. The network interface 27 includes the appropriate hardware and software so that the device can interact with another device over a network, for example, the server 2 shown in FIG. 1. The processor 21 is connected to driver controller 29 which is connected to an array driver 22 and to frame buffer 28. In some embodiments, the processor 21 is also connected to the array driver 22. The array driver 22 is connected to and drives the display array 30. The components illustrated in FIG. 3A illustrate a configuration of an interferometric modulator display. However, this configuration can also be used in a LCD with an LCD controller and driver. As illustrated in FIG. 3A, the driver controller 29 is connected to the processor 21 via a parallel bus 36. Although a driver controller 29, such as a LCD controller, is often associated with the system processor 21, as a standalone Integrated Circuit (IC), such controllers may be implemented in many ways. They may be embedded in the processor 21 as hardware, embedded in the processor 21 as software, or fully integrated in hardware with the array driver 22. In one embodiment, the driver controller 29 takes the display information generated by the processor 21, reformats that information appropriately for high speed transmission to the display array 30, and sends the formatted information to the array driver 22.

The array driver 22 receives the formatted information from the driver controller 29 and reformats the video data into a parallel set of waveforms that are applied many times per second to the hundreds and sometimes thousands of leads coming from the display's x-y matrix of pixels. The currently available flat panel display controllers and drivers such as those described immediately above have been designed to work almost exclusively with displays that need to be constantly refreshed. Because bi-stable displays (e.g., an array of interferometric modulators) do not require such constant refreshing, features that decrease power requirements may be realized through the use of bi-stable displays. However, if bi-stable displays are operated by the controllers and drivers that are used with current displays the advantages of a bi-stable display may not be optimized. Thus, improved controller and driver systems and methods for use with bi-stable displays are desired. For high speed bi-stable displays, such as the interferometric modulators described above, these improved controllers and drivers preferably implement low-refresh-rate modes, video rate refresh modes, and unique modes to facilitate the unique capabilities of bi-stable modulators. According to the methods and systems described herein, a bi-stable display may be configured to reduce power requirements in various manners.

In one embodiment illustrated by FIG. 3A, the array driver 22 receives video data from the processor 21 via a data link 31 bypassing the driver controller 29. The data link 31 may comprise a serial peripheral interface ("SPI"), $I^2C$ bus, parallel bus, or any other available interface. In one embodiment shown in FIG. 3A, the processor 21 provides instructions to the array driver 22 that allow the array driver 22 to optimize the power requirements of the display array 30 (e.g., an interferometric modulator display). In one embodiment, video data intended for a portion of the display, such as for example defined by the server 2, can be identified by data packet header information and transmitted via the data link 31. In addition, the processor 21 can route primitives, such as graphical primitives, along data link 31 to the array driver 22. These graphical primitives can correspond to instructions such as primitives for drawing shapes and text.

Still referring to FIG. 3A, in one embodiment, video data may be provided from the network interface 27 to the array driver 22 via data link 33. In one embodiment, the network interface 27 analyzes control information that is transmitted from the server 2 and determines whether the incoming video should be routed to either the processor 21 or, alternatively, the array driver 22.

In one embodiment, video data provided by data link 33 is not stored in the frame buffer 28, as is usually the case in many embodiments. It will also be understood that in some embodiments, a second driver controller (not shown) can also be used to render video data for the array driver 22. The data link 33 may comprise a SPI, $I^2C$ bus, or any other available interface. The array driver 22 can also include address decoding, row and column drivers for the display and the like. The network interface 27 can also provide video data directly to the array driver 22 at least partially in response to instructions embedded within the video data provided to the network interface 27. It will be understood by the skilled practitioner that arbiter logic can be used to control access by the network interface 27 and the processor 21 to prevent data collisions at the array driver 22. In one embodiment, a driver executing on the processor 21 controls the timing of data transfer from the network interface 27 to the array driver 22 by permitting the data transfer during time intervals that are typically unused by the processor 21, such as time intervals traditionally used for vertical blanking delays and/or horizontal blanking delays.

Advantageously, this design permits the server 2 to bypass the processor 21 and the driver controller 29, and to directly address a portion of the display array 30. For example, in the illustrated embodiment, this permits the server 2 to directly address a predefined display array area of the display array 30. In one embodiment, the amount of data communicated between the network interface 27 and the array driver 22 is relatively low and is communicated using a serial bus, such as an Inter-Integrated Circuit ($I^2C$) bus or a Serial Peripheral Interface (SPI) bus. It will also be understood, however, that where other types of displays are utilized, that other circuits will typically also be used. The video data provided via data link 33 can advantageously be displayed without a frame buffer 28 and with little or no intervention from the processor 21.

FIG. 3A also illustrates a configuration of a processor 21 coupled to a driver controller 29, such as an interferometric modulator controller. The driver controller 29 is coupled to the array driver 22, which is connected to the display array 30. In this embodiment, the driver controller 29 accounts for the display array 30 optimizations and provides information to the array driver 22 without the need for a separate connection between the array driver 22 and the processor 21. In some embodiments, the processor 21 can be configured to communicate with a driver controller 29, which can include a frame buffer 28 for temporary storage of one or more frames of video data.

As shown in FIG. 3A, in one embodiment the array driver 22 includes a row driver circuit 24 and a column driver circuit 26 that provide signals to a pixel display array 30. The cross section of the array illustrated in FIG. 2 is shown by the lines 1-1 in FIG. 3A. For MEMS interferometric modulators, the row/column actuation protocol may take advantage of a hysteresis property of these devices illustrated in FIG. 4A. It may require, for example, a 10 volt potential difference to cause a movable layer to deform from the released state to the actuated state. However, when the voltage is reduced from that value, the movable layer maintains its state as the voltage drops back below 10 volts. In the exemplary embodiment of FIG. 4A, the movable layer does not release completely until the voltage drops below 2 volts. There is thus a range of voltage, about 3 to 7 V in the example illustrated in FIG. 4A, where there exists a window of applied voltage within which the device is stable in either the released or actuated state. This is referred to herein as the "hysteresis window" or "stability window."

Figures 4A, 4B:
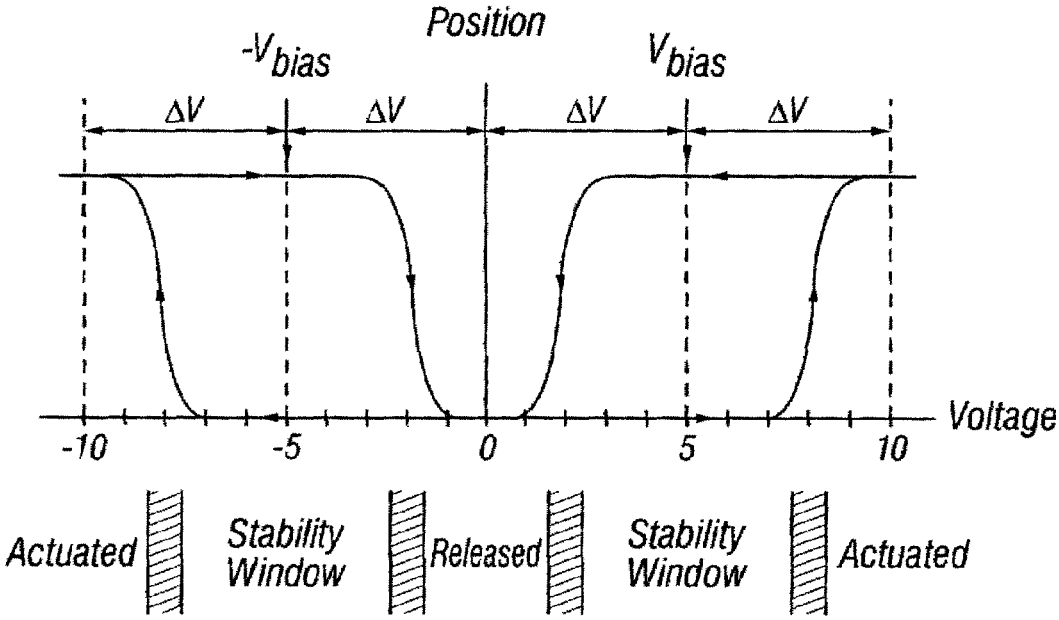
FIG. 4A is a diagram of movable mirror position versus applied voltage for one exemplary embodiment of an interferometric modulator of FIG. 2.
FIG. 4B is an illustration of a set of row and column voltages that may be used to drive an interferometric modulator display array.

For a display array having the hysteresis characteristics of FIG. 4A, the row/column actuation protocol can be designed such that during row strobing, pixels in the strobed row that are to be actuated are exposed to a voltage difference of about 10 volts, and pixels that are to be released are exposed to a voltage difference of close to zero volts. After the strobe, the pixels are exposed to a steady state voltage difference of about 5 volts such that they remain in whatever state the row strobe put them in. After being written, each pixel sees a potential difference within the "stability window" of 3-7 volts in this example. This feature makes the pixel design illustrated in FIG. 2 stable under the same applied voltage conditions in either an actuated or released pre-existing state. Since each pixel of the interferometric modulator, whether in the actuated or released state, is essentially a capacitor formed by the fixed and moving reflective layers, this stable state can be held at a voltage within the hysteresis window with almost no power dissipation. Essentially no current flows into the pixel if the applied potential is fixed.

In typical applications, a display frame may be created by asserting the set of column electrodes in accordance with the desired set of actuated pixels in the first row. A row pulse is then applied to the row 1 electrode, actuating the pixels corresponding to the asserted column lines. The asserted set of column electrodes is then changed to correspond to the desired set of actuated pixels in the second row. A pulse is then applied to the row 2 electrode, actuating the appropriate pixels in row 2 in accordance with the asserted column electrodes. The row 1 pixels are unaffected by the row 2 pulse, and remain in the state they were set to during the row 1 pulse. This may be repeated for the entire series of rows in a sequential fashion to produce the frame. Generally, the frames are refreshed and/or updated with new video data by continually repeating this process at some desired number of frames per second. A wide variety of protocols for driving row and column electrodes of pixel arrays to produce display array frames are also well known and may be used.

Figure 3B:
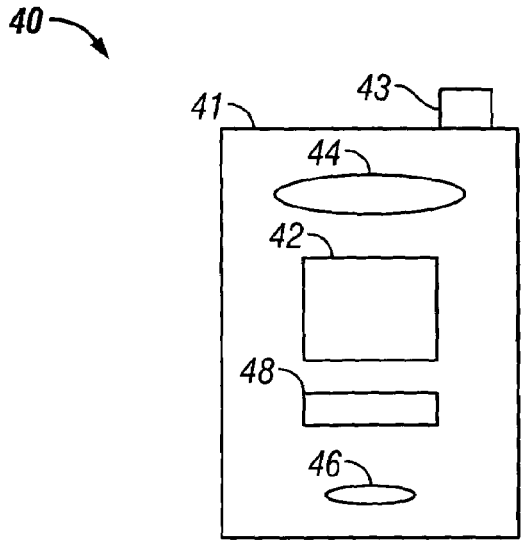
FIG. 3B is an illustration of an embodiment of a client of the server-based wireless network system of FIG. 1.

One embodiment of a client device 7 is illustrated in FIG. 3B. The exemplary client 40 includes a housing 41, a display 42, an antenna 43, a speaker 44, an input device 48, and a microphone 46. The housing 41 is generally formed from any of a variety of manufacturing processes as are well known to those of skill in the art, including injection molding, and vacuum forming. In addition, the housing 41 may be made from any of a variety of materials, including but not limited to plastic, metal, glass, rubber, and ceramic, or a combination thereof. In one embodiment the housing 41 includes removable portions (not shown) that may be interchanged with other removable portions of different color, or containing different logos, pictures, or symbols.

The display 42 of exemplary client 40 may be any of a variety of displays, including a bi-stable display, as described herein with respect to, for example, FIGS. 2, 3A, and 4-6. In other embodiments, the display 42 includes a flat-panel display, such as plasma, EL, OLED, STN LCD, or TFT LCD as described above, or a non-flat-panel display, such as a CRT or other tube device, as is well known to those of skill in the art. However, for purposes of describing the present embodiment, the display 42 includes an interferometric modulator display, as described herein.

Figure 3C:
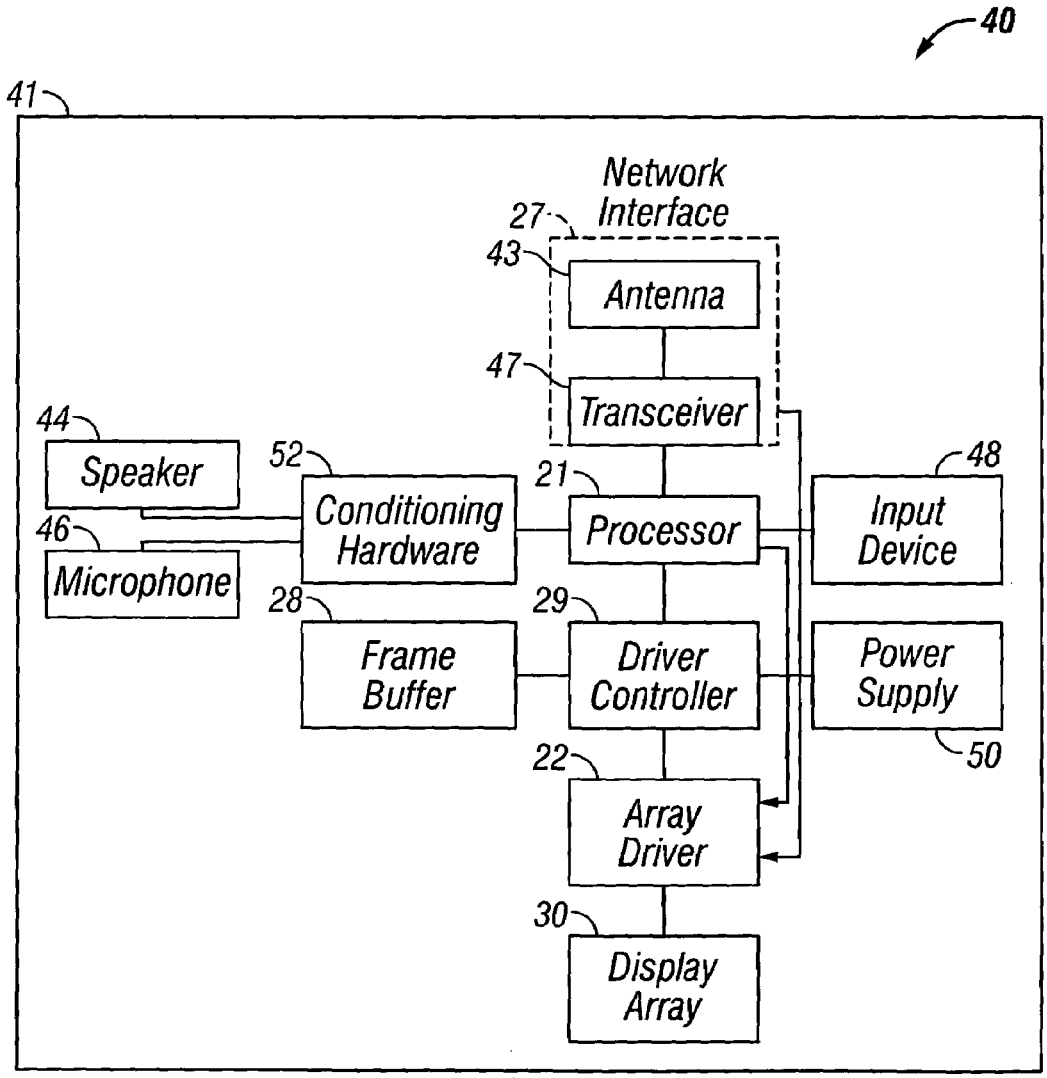
FIG. 3C is an exemplary block diagram configuration of the client in FIG. 3B.

The components of one embodiment of exemplary client 40 are schematically illustrated in FIG. 3C. The illustrated exemplary client 40 includes a housing 41 and can include additional components at least partially enclosed therein. For example, in one embodiment, the client exemplary 40 includes a network interface 27 that includes an antenna 43 which is coupled to a transceiver 47. The transceiver 47 is connected to a processor 21, which is connected to conditioning hardware 52. The conditioning hardware 52 is connected to a speaker 44 and a microphone 46. The processor 21 is also connected to an input device 48 and a driver controller 29. The driver controller 29 is coupled to a frame buffer 28, and to an array driver 22, which in turn is coupled to a display array 30. A power supply 50 provides power to all components as required by the particular exemplary client 40 design.

The network interface 27 includes the antenna 43, and the transceiver 47 so that the exemplary client 40 can communicate with another device over a network 3, for example, the server 2 shown in FIG. 1. In one embodiment the network interface 27 may also have some processing capabilities to relieve requirements of the processor 21. The antenna 43 is any antenna known to those of skill in the art for transmitting and receiving signals. In one embodiment, the antenna transmits and receives RF signals according to the IEEE 802.11 standard, including IEEE 802.11(a), (b), or (g). In another embodiment, the antenna transmits and receives RF signals according to the BLUETOOTH standard. In the case of a cellular telephone, the antenna is designed to receive CDMA, GSM, AMPS or other known signals that are used to communicate within a wireless cell phone network. The transceiver 47 pre-processes the signals received from the antenna 43 so that they may be received by and further processed by the processor 21. The transceiver 47 also processes signals received from the processor 21 so that they may be transmitted from the exemplary client 40 via the antenna 43.

Processor 21 generally controls the overall operation of the exemplary client 40, although operational control may be shared with or given to the server 2 (not shown), as will be described in greater detail below. In one embodiment, the processor 21 includes a microcontroller, CPU, or logic unit to control operation of the exemplary client 40. Conditioning hardware 52 generally includes amplifiers and filters for transmitting signals to the speaker 44, and for receiving signals from the microphone 46. Conditioning hardware 52 may be discrete components within the exemplary client 40, or may be incorporated within the processor 21 or other components.

The input device 48 allows a user to control the operation of the exemplary client 40. In one embodiment, input device 48 includes a keypad, such as a QWERTY keyboard or a telephone keypad, a button, a switch, a touch-sensitive screen, a pressure- or heat-sensitive membrane. In one embodiment, a microphone is an input device for the exemplary client 40. When a microphone is used to input data to the device, voice commands may be provided by a user for controlling operations of the exemplary client 40.

In one embodiment, the driver controller 29, array driver 22, and display array 30 are appropriate for any of the types of displays described herein. For example, in one embodiment, driver controller 29 is a conventional display controller or a bi-stable display controller (e.g., an interferometric modulator controller). In another embodiment, array driver 22 is a conventional driver or a bi-stable display driver (e.g., a interferometric modulator display). In yet another embodiment, display array 30 is a typical display array or a bi-stable display array (e.g., a display including an array of interferometric modulators).

Power supply 50 is any of a variety of energy storage devices as are well known in the art. For example, in one embodiment, power supply 50 is a rechargeable battery, such as a nickel-cadmium battery or a lithium ion battery. In another embodiment, power supply 50 is a renewable energy source, a capacitor, or a solar cell, including a plastic solar cell, and solar-cell paint. In another embodiment, power supply 50 is configured to receive power from a wall outlet.

In one embodiment, the array driver 22 contains a register that may be set to a predefined value to indicate that the input video stream is in an interlaced format and should be displayed on the bi-stable display in an interlaced format, without converting the video stream to a progressive scanned format. In this way the bi-stable display does not require interlace-to-progressive scan conversion of interlace video data.

In some implementations control programmability resides, as described above, in a display controller which can be located in several places in the electronic display system. In some cases control programmability resides in the array driver 22 located at the interface between the electronic display system and the display component itself. Those of skill in the art will recognize that the above-described optimization may be implemented in any number of hardware and/or software components and in various configurations.

In one embodiment, circuitry is embedded in the array driver 22 to take advantage of the fact that the output signal set of most graphics controllers includes a signal to delineate the horizontal active area of the display array 30 being addressed. This horizontal active area can be changed via register settings in the driver controller 29. These register settings can be changed by the processor 21. This signal is usually designated as display enable (DE). Most all display video interfaces in addition utilize a line pulse (LP) or a horizontal synchronization (HSYNC) signal, which indicates the end of a line of data. A circuit which counts LPs can determine the vertical position of the current row. When refresh signals are conditioned upon the DE from the processor 21 (signaling for a horizontal region), and upon the LP counter circuit (signaling for a vertical region) an area update function can be implemented.

In one embodiment, a driver controller 29 is integrated with the array driver 22. Such an embodiment is common in highly integrated systems such as cellular phones, watches, and other small area displays. Specialized circuitry within such an integrated array driver 22 first determines which pixels and hence rows require refresh, and only selects those rows that have pixels that have changed to update. With such circuitry, particular rows can be addressed in non-sequential order, on a changing basis depending on image content. This embodiment has the advantage that since only the changed video data needs to be sent through the interface, data rates can be reduced between the processor 21 and the display array 30. Lowering the effective data rate required between processor 21 and array driver 22 improves power consumption, noise immunity and electromagnetic interference issues for the system.

FIGS. 4 and 5 illustrate one possible actuation protocol for creating a display frame on the 3×3 array of FIG. 3. FIG. 4B illustrates a possible set of column and row voltage levels that may be used for pixels exhibiting the hysteresis curves of FIG. 4A. In the FIG. 4A/4B embodiment, actuating a pixel may involve setting the appropriate column to $-V_{bias}$, and the appropriate row to $+\Delta V$, which may correspond to −5 volts and +5 volts respectively. Releasing the pixel may be accomplished by setting the appropriate column to $+V_{bias}$, and the appropriate row to the same $+\Delta V$, producing a zero volt potential difference across the pixel. In those rows where the row voltage is held at zero volts, the pixels are stable in whatever state they were originally in, regardless of whether the column is at $+V_{bias}$, or $-V_{bias}$. Similarly, actuating a pixel may involve setting the appropriate column to $+V_{bias}$, and the appropriate row to $-\Delta V$, which may correspond to 5 volts and −5 volts respectively. Releasing the pixel may be accomplished by setting the appropriate column to $-V_{bias}$, and the appropriate row to the same $-\Delta V$, producing a zero volt potential difference across the pixel. In those rows where the row voltage is held at zero volts, the pixels are stable in whatever state they were originally in, regardless of whether the column is at $+V_{bias}$, or $-V_{bias}$.

Figure 5A:
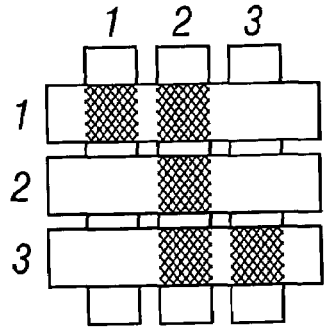
FIGS. 5A and 5B illustrate one exemplary timing diagram for row and column signals that may be used to write a frame of data to the 3×3 interferometric modulator display array of FIG. 3A.
Figure 5B:
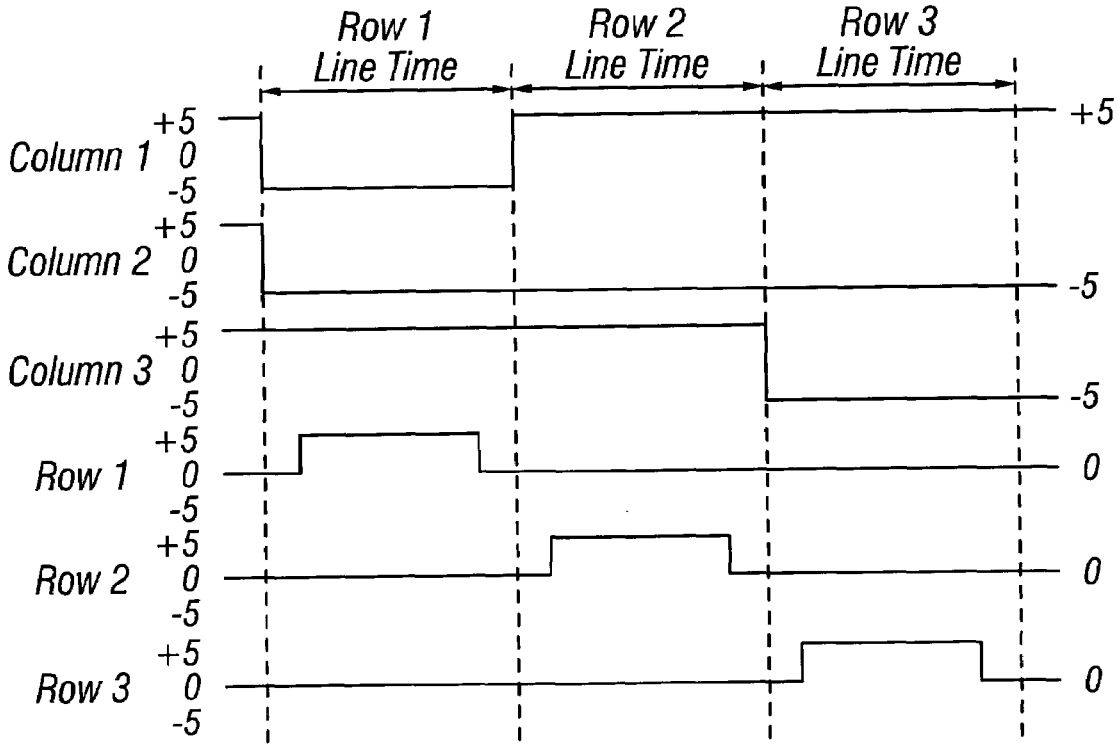

FIG. 5B is a timing diagram showing a series of row and column signals applied to the 3×3 array of FIG. 3A which will result in the display arrangement illustrated in FIG. 5A, where actuated pixels are non-reflective. Prior to writing the frame illustrated in FIG. 5A, the pixels can be in any state, and in this example, all the rows are at 0 volts, and all the columns are at +5 volts. With these applied voltages, all pixels are stable in their existing actuated or released states.

In the FIG. 5A frame, pixels (1,1), (1,2), (2,2), (3,2) and (3,3) are actuated. To accomplish this, during a "line time" for row 1, columns 1 and 2 are set to −5 volts, and column 3 is set to +5 volts. This does not change the state of any pixels, because all the pixels remain in the 3-7 volt stability window. Row 1 is then strobed with a pulse that goes from 0, up to 5 volts, and back to zero. This actuates the (1,1) and (1,2) pixels and releases the (1,3) pixel. No other pixels in the array are affected. To set row 2 as desired, column 2 is set to −5 volts, and columns 1 and 3 are set to +5 volts. The same strobe applied to row 2 will then actuate pixel (2,2) and release pixels (2,1) and (2,3). Again, no other pixels of the array are affected. Row 3 is similarly set by setting columns 2 and 3 to −5 volts, and column 1 to +5 volts. The row 3 strobe sets the row 3 pixels as shown in FIG. 5A. After writing the frame, the row potentials are zero, and the column potentials can remain at either +5 or −5 volts, and the display is then stable in the arrangement of FIG. 5A. It will be appreciated that the same procedure can be employed for arrays of dozens or hundreds of rows and columns. It will also be appreciated that the timing, sequence, and levels of voltages used to perform row and column actuation can be varied widely within the general principles outlined above, and the above example is exemplary only, and any actuation voltage method can be used.

Figure 6A:
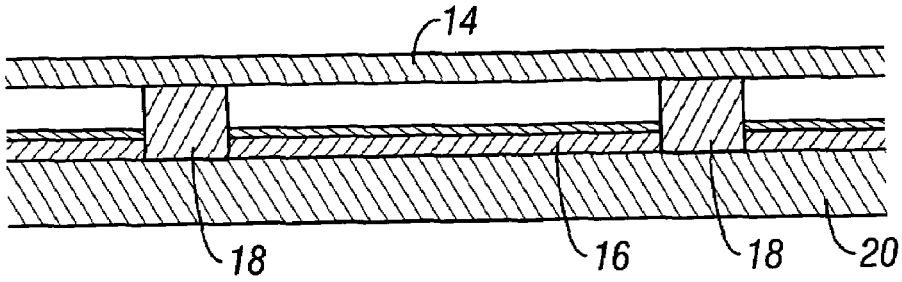
FIG. 6A is a cross section of the interferometric modulator of FIG. 2.
Figure 6B:
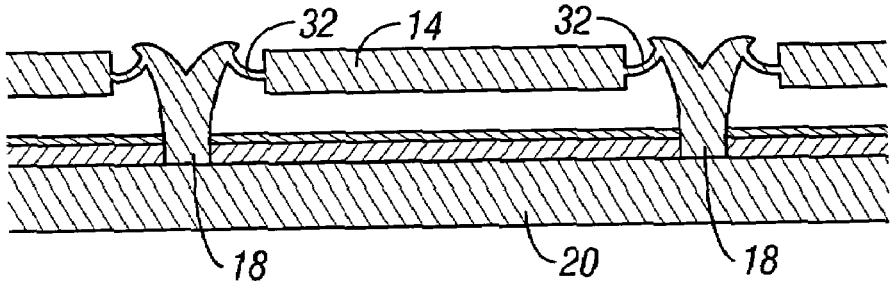
FIG. 6B is a cross section of an alternative embodiment of an interferometric modulator.
Figure 6C:
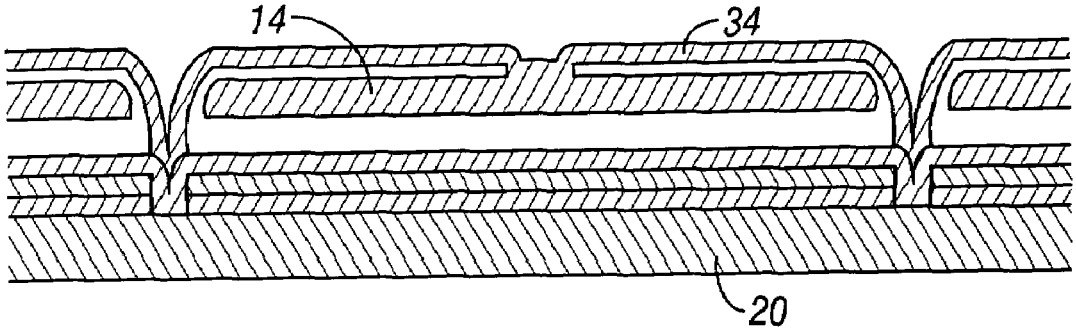
FIG. 6C is a cross section of another alternative embodiment of an interferometric modulator.

The details of the structure of interferometric modulators that operate in accordance with the principles set forth above may vary widely. For example, FIGS. 6A-6C illustrate three different embodiments of the moving mirror structure. FIG. 6A is a cross section of the embodiment of FIG. 2, where a strip of reflective material 14 is deposited on orthogonal supports 18. In FIG. 6B, the reflective material 14 is attached to supports 18 at the corners only, on tethers 32. In FIG. 6C, the reflective material 14 is suspended from a deformable layer 34. This embodiment has benefits because the structural design and materials used for the reflective material 14 can be optimized with respect to the optical properties, and the structural design and materials used for the deformable layer 34 can be optimized with respect to desired mechanical properties. The production of various types of interferometric devices is described in a variety of published documents, including, for example, U.S. Published Application 2004/0051929. A wide variety of well known techniques may be used to produce the above described structures involving a series of material deposition, patterning, and etching steps.

Figure 7:
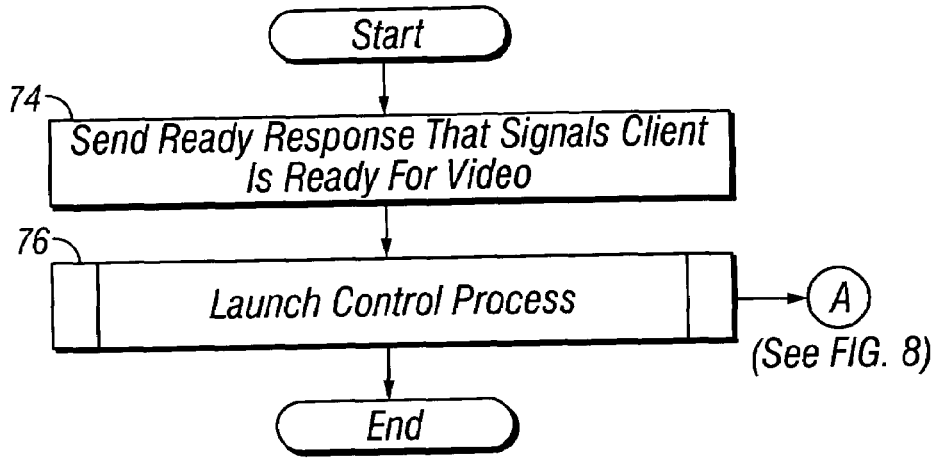
FIG. 7 is a high level flowchart of a client control process.

An embodiment of process flow is illustrated in FIG. 7, which shows a high-level flowchart of a client device 7 control process. This flowchart describes the process used by a client device 7, such as a laptop computer 4, a PDA 5, or a cell phone 6, connected to a network 3, to graphically display video data, received from a server 2 via the network 3. Depending on the embodiment, states of FIG. 7 can be removed, added, or rearranged.

Again referring to FIG. 7, starting at state 74 the client device 7 sends a signal to the server 2 via the network 3 that indicates the client device 7 is ready for video. In one embodiment a user may start the process of FIG. 7 by turning on an electronic device such as a cell phone. Continuing to state 76 the client device 7 launches its control process. An example of launching a control process is discussed further with reference to FIG. 8.

Figure 8:
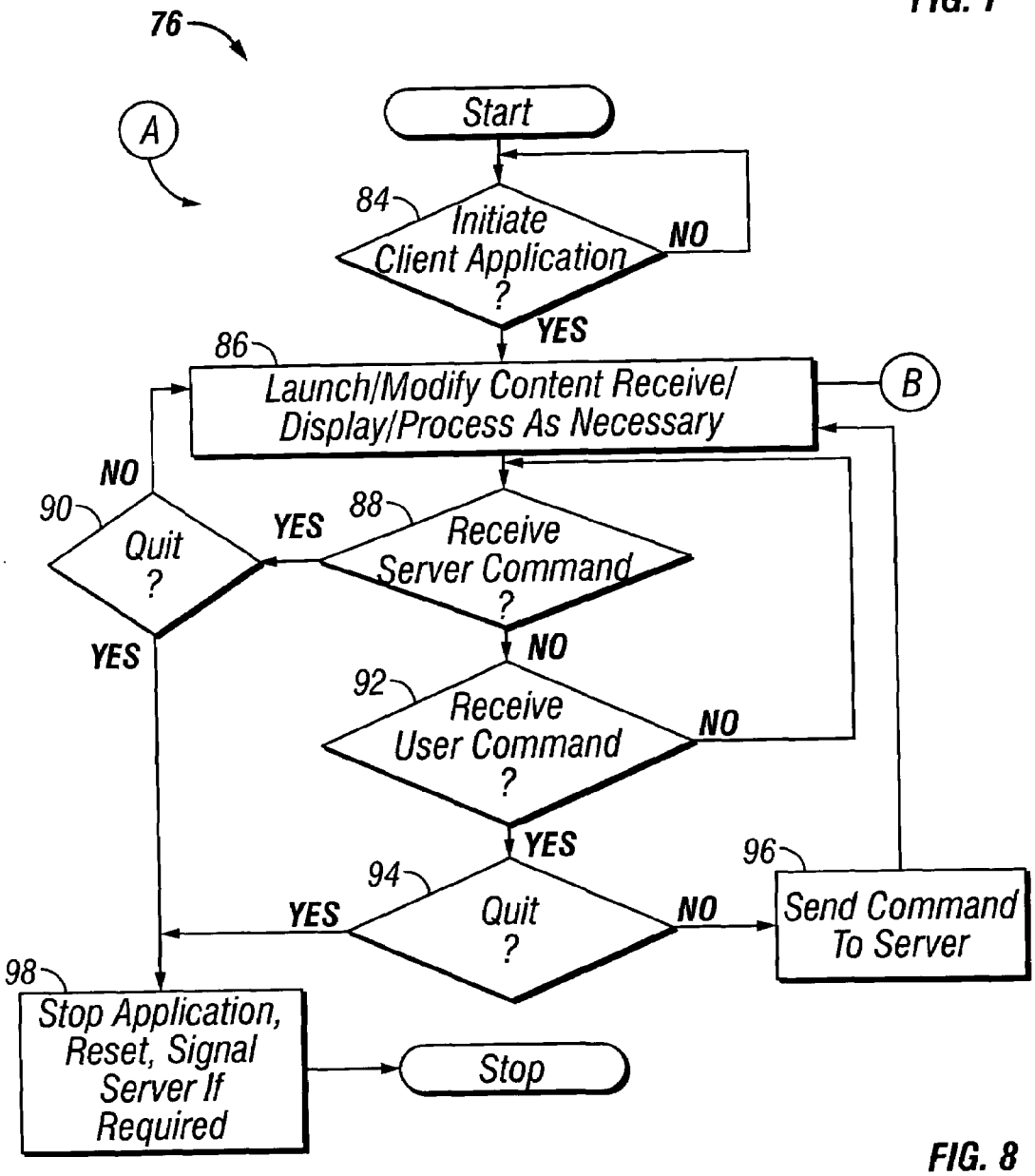
FIG. 8 is a flowchart of a client control process for launching and running a receive/display process.

An embodiment of process flow is illustrated in FIG. 8, which shows a flowchart of a client device 7 control process for launching and running a control process. This flowchart illustrates in further detail state 76 discussed with reference to FIG. 7. Depending on the embodiment, states of FIG. 8 can be removed, added, or rearranged.

Starting at decision state 84, the client device 7 makes a determination whether an action at the client device 7 requires an application at the client device 7 to be started, or whether the server 2 has transmitted an application to the client device 7 for execution, or whether the server 2 has transmitted to the client device 7 a request to execute an application resident at the client device 7. If there is no need to launch an application the client device 7 remains at decision state 84. After starting an application, continuing to state 86, the client device 7 launches a process by which the client device 7 receives and displays video data. The video data may stream from the server 2, or may be downloaded to the client device 7 memory for later access. The video data can be video, or a still image, or textual or pictorial information. The video data can also have various compression encodings, and be interlaced or progressively scanned, and have various and varying refresh rates. The display array 30 may be segmented into regions of arbitrary shape and size, each region receiving video data with characteristics, such as refresh rate or compression encoding, specific only to that region. The regions may change video data characteristics and shape and size. The regions may be opened and closed and re-opened. Along with video data, the client device 7 can also receive control data. The control data can comprise commands from the server 2 to the client device 7 regarding, for example, video data characteristics such as compression encoding, refresh rate, and interlaced or progressively scanned video data. The control data may contain control instructions for segmentation of display array 30, as well as differing instructions for different regions of display array 30.

In one exemplary embodiment, the server 2 sends control and video data to a PDA via a wireless network 3 to produce a continuously updating clock in the upper right corner of the display array 30, a picture slideshow in the upper left corner of the display array 30, a periodically updating score of a ball game along a lower region of the display array 30, and a cloud shaped bubble reminder to buy bread continuously scrolling across the entire display array 30. The video data for the photo slideshow are downloaded and reside in the PDA memory, and they are in an interlaced format. The clock and the ball game video data stream text from the server 2. The reminder is text with a graphic and is in a progressively scanned format. It is appreciated that here presented is only an exemplary embodiment. Other embodiments are possible and are encompassed by state 86 and fall within the scope of this discussion.

Continuing to decision state 88, the client device 7 looks for a command from the server 2, such as a command to relocate a region of the display array 30, a command to change the refresh rate for a region of the display array 30, or a command to quit. Upon receiving a command from the server 2, the client device 7 proceeds to decision state 90, and determines whether or not the command received while at decision state 88 is a command to quit. If, while at decision state 90, the command received while at decision state 88 is determined to be a command to quit, the client device 7 continues to state 98, and stops execution of the application and resets. The client device 7 may also communicate status or other information to the server 2, and/or may receive such similar communications from the server 2. If, while at decision state 90, the command received from the server 2 while at decision state 88 is determined to not be a command to quit, the client device 7 proceeds back to state 86. If, while at decision state 88, a command from the server 2 is not received, the client device 7 advances to decision state 92, at which the client device 7 looks for a command from the user, such as a command to stop updating a region of the display array 30, or a command to quit. If, while at decision state 92, the client device 7 receives no command from the user, the client device 7 returns to decision state 88. If, while at decision state 92, a command from the user is received, the client device 7 proceeds to decision state 94, at which the client device 7 determines whether or not the command received in decision state 92 is a command to quit. If, while at decision state 94, the command from the user received while at decision state 92 is not a command to quit, the client device 7 proceeds from decision state 94 to state 96. At state 96 the client device 7 sends to the server 2 the user command received while at state 92, such as a command to stop updating a region of the display array 30, after which it returns to decision state 88. If, while at decision state 94, the command from the user received while at decision state 92 is determined to be a command to quit, the client device 7 continues to state 98, and stops execution of the application. The client device 7 may also communicate status or other information to the server 2, and/or may receive such similar communications from the server 2.

Figure 9:
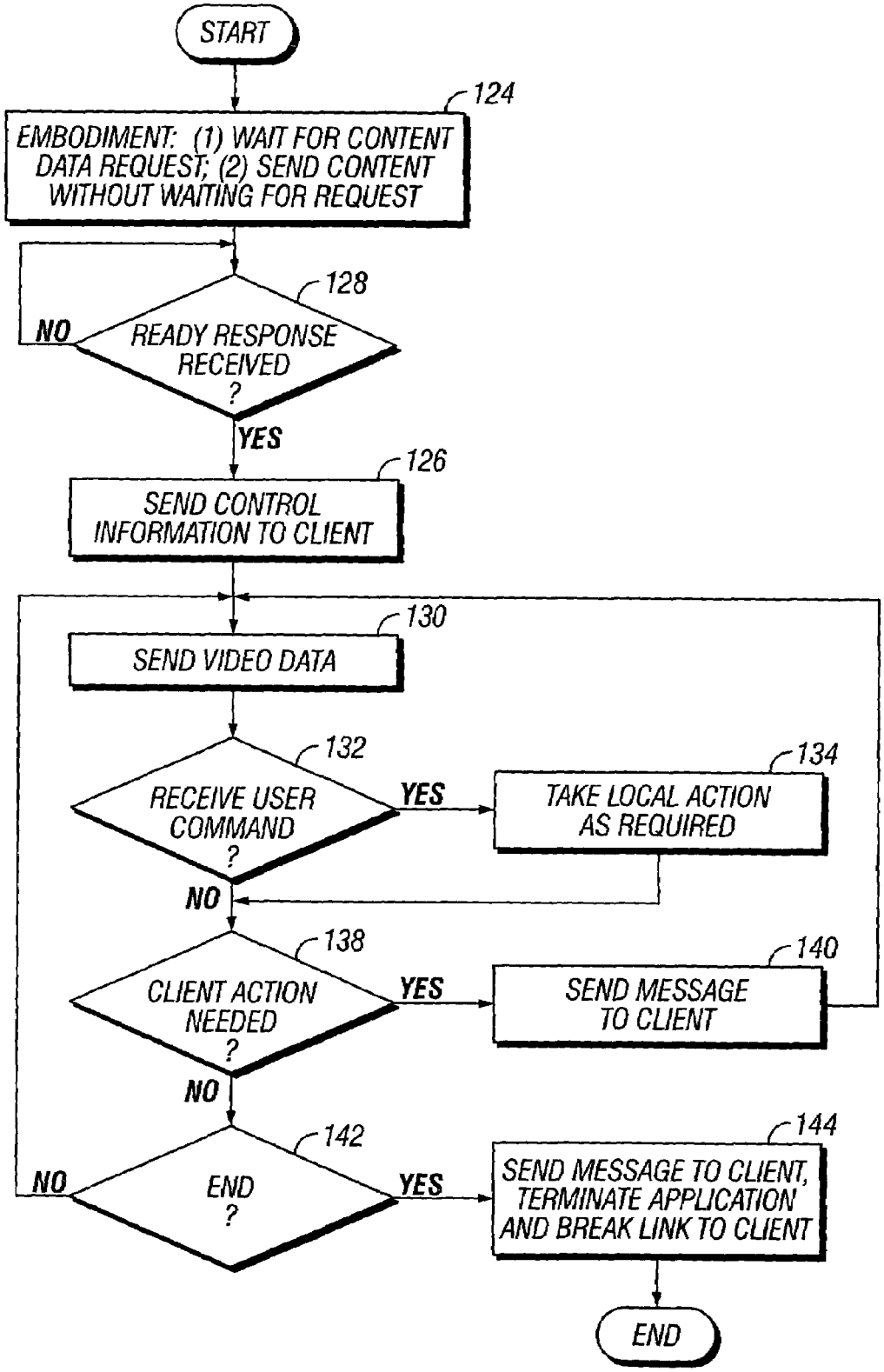
FIG. 9 is a flowchart of a server control process for sending video data to a client.

FIG. 9 illustrates a control process by which the server 2 sends video data to the client device 7. The server 2 sends control information and video data to the client device 7 for display. Depending on the embodiment, states of FIG. 9 can be removed, added, or rearranged.

Starting at state 124 the server 2, in embodiment (1), waits for a data request via the network 3 from the client device 7, and alternatively, in embodiment (2) the server 2 sends video data without waiting for a data request from the client device 7. The two embodiments encompass scenarios in which either the server 2 or the client device 7 may initiate requests for video data to be sent from the server 2 to the client device 7.

The server 2 continues to decision state 128, at which a determination is made as to whether or not a response from the client device 7 has been received indicating that the client device 7 is ready (ready indication signal). If, while at state 128, a ready indication signal is not received, the server 2 remains at decision state 128 until a ready indication signal is received.

Once a ready indication signal is received, the server 2 proceeds to state 126, at which the server 2 sends control data to the client device 7. The control data may stream from the server 2, or may be downloaded to the client device 7 memory for later access. The control data may segment the display array 30 into regions of arbitrary shape and size, and may define video data characteristics, such as refresh rate or interlaced format for a particular region or all regions. The control data may cause the regions to be opened or closed or re-opened.

Continuing to state 130, the server 2 sends video data. The video data may stream from the server 2, or may be downloaded to the client device 7 memory for later access. The video data can include motion images, or still images, textual or pictorial images. The video data can also have various compression encodings, and be interlaced or progressively scanned, and have various and varying refresh rates. Each region may receive video data with characteristics, such as refresh rate or compression encoding, specific only to that region.

The server 2 proceeds to decision state 132, at which the server 2 looks for a command from the user, such as a command to stop updating a region of the display array 30, to increase the refresh rate, or a command to quit. If, while at decision state 132, the server 2 receives a command from the user, the server 2 advances to state 134. At state 134 the server 2 executes the command received from the user at state 132, and then proceeds to decision state 138. If, while at decision state 132, the server 2 receives no command from the user, the server 2 advances to decision state 138.

At state 138 the server 2 determines whether or not action by the client device 7 is needed, such as an action to receive and store video data to be displayed later, to increase the data transfer rate, or to expect the next set of video data to be in interlaced format. If, while at decision state 138, the server 2 determines that an action by the client is needed, the server 2 advances to state 140, at which the server 2 sends a command to the client device 7 to take the action, after which the server 2 then proceeds to state 130. If, while at decision state 138, the server 2 determines that an action by the client is not needed, the server 2 advances to decision state 142.

Continuing at decision state 142, the server 2 determines whether or not to end data transfer. If, while at decision state 142, the server 2 determines to not end data transfer, server 2 returns to state 130. If, while at decision state 142, the server 2 determines to end data transfer, server 2 proceeds to state 144, at which the server 2 ends data transfer, and sends a quit message to the client. The server 2 may also communicate status or other information to the client device 7, and/or may receive such similar communications from the client device 7.

Figure 10:
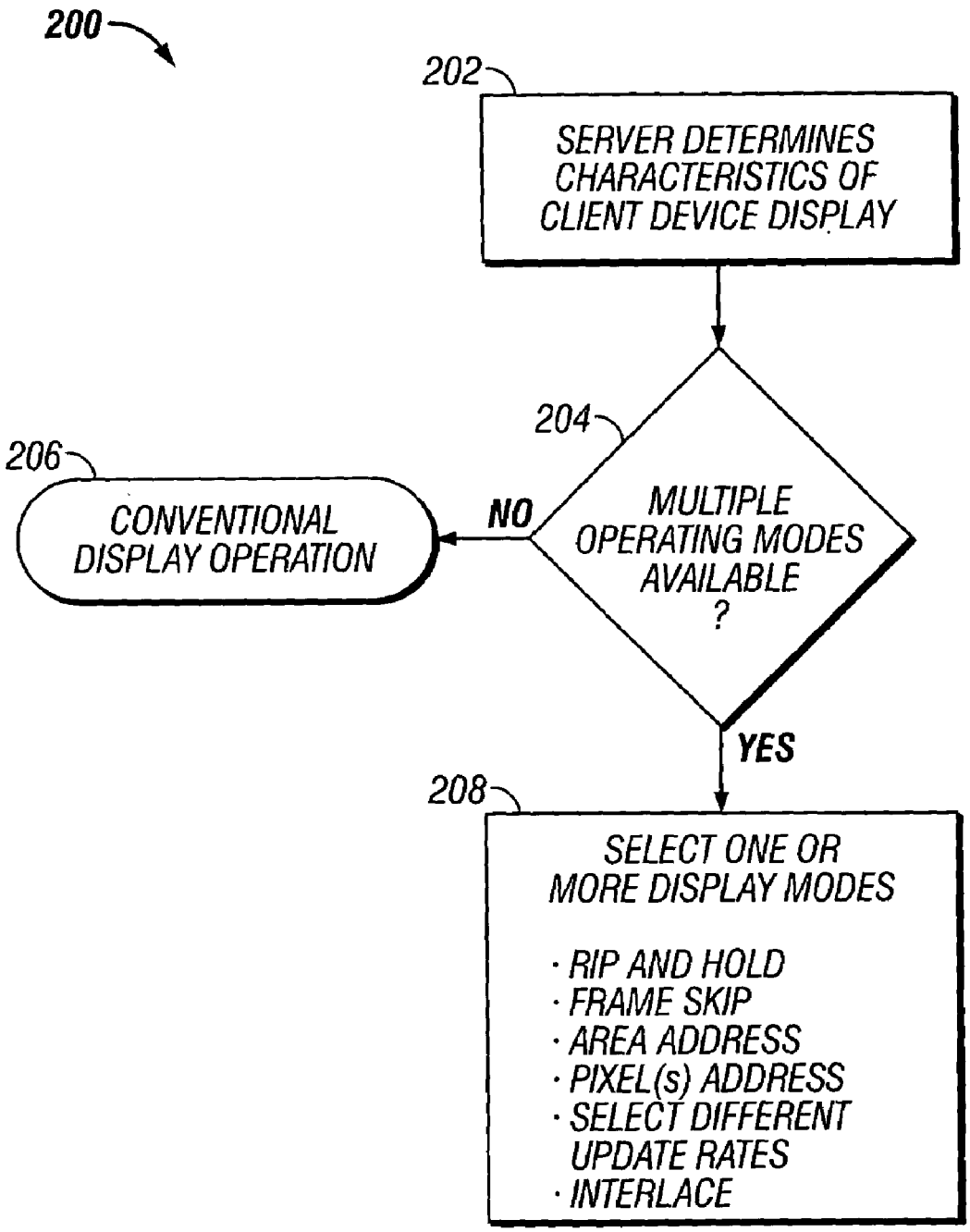
FIG. 10 is a flow chart of one embodiment of a system and method for server driven control of client device display features.

FIG. 10 illustrates a flowchart of one embodiment of a process 200 of operating the system shown in FIGS. 1 and 3A. The process 200 shown in FIG. 10 can be used in a system, for example the system shown in FIG. 1, where a server 2 communicates with numerous client devices 7 and each client device 7 has a display that may or may not have similar operating characteristics as the displays on the other client devices. The process 200 illustrates the server 2 determining characteristics of the display of a client device 7 and if the display is capable of using multiple operating modes and then utilizing one or more of the displays' operating modes to display data. To determine the display type of its client devices 7, the server 2 can receive information indicating the display characteristics of each client device 7. In some embodiments, determining the display characteristics of the client device 7 occurs while the client device 7 is establishing communications with the server 2, for example, as part of a server-client initialization process. In other embodiments the server 2 can communicate with the client device 7 to receive display characteristics after the client device 7 (FIG. 1) has established communications with the server 2 (FIG. 1). In one embodiment, the process 200 can start before the client device 7 sends a signal to the server 2 indicating that it is ready to receive video data (FIG. 7, state 74), for example, upon an initial communication between the server 2 and the client device 7. Alternatively, the process 200 can start at a time after the initial communication between the server 2 and the client device 7, for example, before or at state 76 (FIG. 7).

Beginning in a state 202, the server 2 determines the display characteristics of the client device 7. The characteristics can include information on the display type of the client device 7, for example, whether the display of the client device 7 is a bi-stable display, such as the display array 30 of FIG. 3A. The server 7 can determine the display characteristics of client device 7 in several ways. In one embodiment, the server 2 can be pre-programmed with information that describes characteristics of displaying information on the display of the client device 7 In another embodiment, the display characteristics of the display device 7 can be identified to the server 2 via the link 8 (FIG. 1), for example, by communicating an identifier of the client device 7 to the server 2. The server 2 can use the identifier of the client device 7 to determine the display characteristics of the client device 7 by indexing client device information that is stored, for example, in a table, database, or file and that is accessible to the server.

Following the characterization of state 202, in state 204 a decision is made, based upon the characteristics determined by the server 22, as to whether an associated client device 7 offers the capability of multiple operating modes or features for the display of the client device 7. If the determination is negative, for example, the client device 7 is of a conventional nature having conventional display types, the process 200 proceeds to a state 206 and the server 2 communicates with the client device 7 to operate the conventional display using it operating mode. However if the determination of state 204 is affirmative, for example, if the client device 7 includes an array 30, the process 200 continues to state 208.

In state 208, the process 200 selects and enables one or more display modes to operate the display array 30 including, for example, rip and hold, frame skip, area address, pixel(s) address, select different update rates, and/or interlace. Selection of the display mode can occur based on pre-programmed values, on user selection, or it can occur dynamically based on the video data displayed. Depending on the embodiment, in FIG. 10 additional steps may be added, other steps my be added or the order of the steps may be rearranged.

The display array 30 can provide numerous operational characteristics which are different from conventional displays, including being able to operate with certain update modes and refresh rates. The following description is of certain representative embodiments of these operating features or modes. The various modes can operate individually as well as in combination with another mode. The described modes or features are particular embodiments of one way of delineating the operation of a display array 30.

One mode that can be selected for operating the display array 30 is referred to herein as a "rip-and-hold" mode of operation. In one embodiment of the rip-and-hold mode, information, e.g., video data, is sent from the server 2 to the client device 7, and a frame depicting at least a portion of the information is rendered or "ripped" as an image on the display. "Ripped" as used herein, refers to rendering any data as an image on the display array 30, not just vector-based data. Because display array 30 does not require a constant refreshing of conventional displays, the display array 30 can "hold" this ripped frame for an extended period of time. In some embodiments, the information is displayed on the entire viewing area of the display array 30, while in other embodiments the information is displayed on a portion of the display array 30, for example, in a partitioned area of the display array 30. The rip-and-hold mode can be performed in an asynchronous and/or aperiodic manners providing additional flexibility in the use of the display array 30.

A second display mode or feature can comprise a "frame-skip" mode or feature for refreshing the display. Because bi-stable displays, as do most flat panel displays, consume most of their power during frame update, it is desirable to be able to control how often a bi-stable display is updated in order to conserve power. For example, if there is very little change between adjacent frames of a video stream, the display array may be refreshed less frequently with little or no loss in image quality. As an example, image quality of typical PC desktop applications, displayed on an interferometric modulator display, would not suffer from a decreased refresh rate, since the interferometric modulator display is not susceptible to the flicker that would result from decreasing the refresh rate of most other displays. Thus, during operation of certain applications, the PC display system may reduce the refresh rate of bi-stable display elements, such as interferometric modulators, with minimal effect on the output of the display.

Figure 11A:
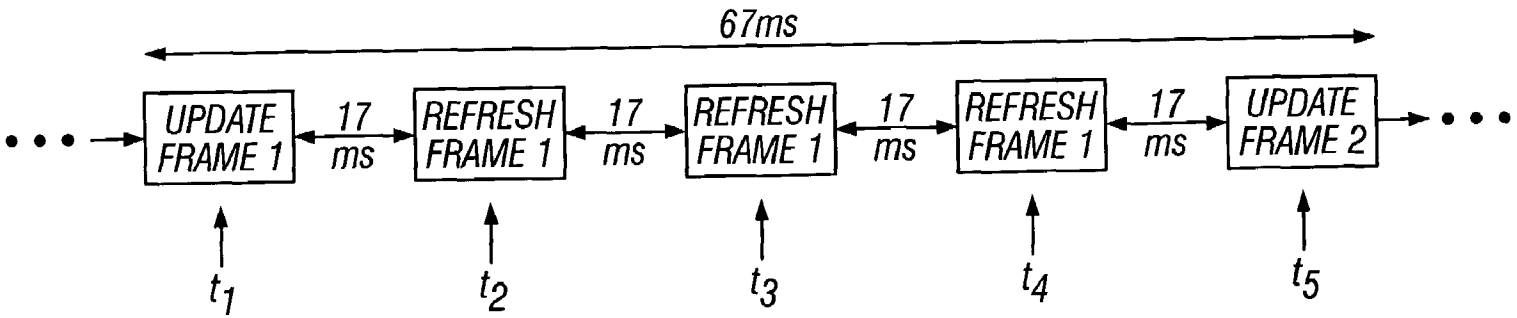
FIG. 11A illustrates one embodiment of updating a typical display with video data.
Figure 11B:
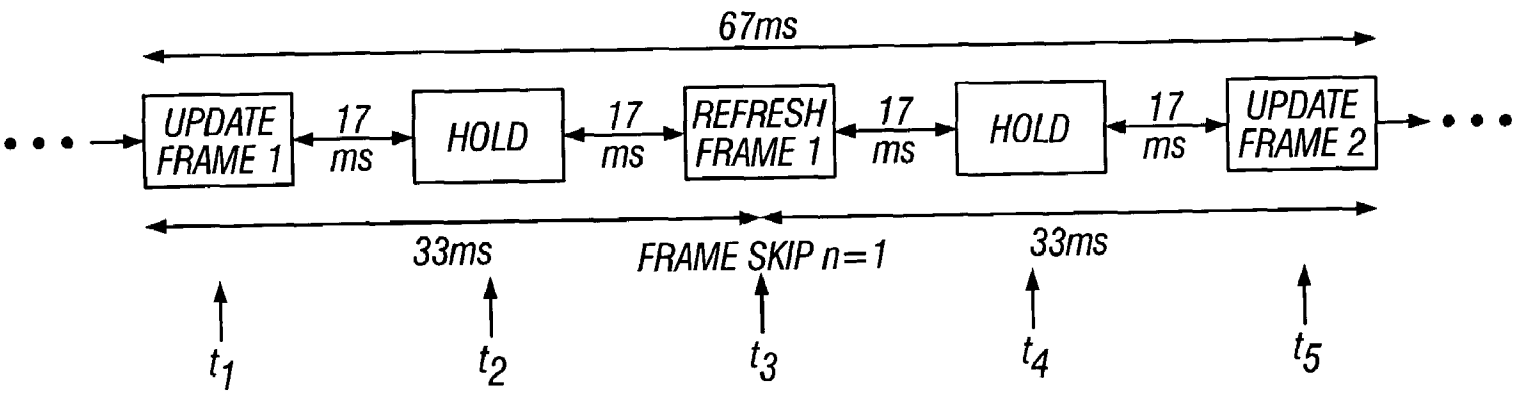
FIG. 11B illustrates one embodiment of updating an interferometric modulator display with video data.

FIGS. 11A and 11B illustrate a frame-skip mode for refreshing video data. FIG. 11A illustrates an operation of displaying video data of a conventional display type. FIG. 11B illustrates one embodiment of the frame-skip feature for refreshing video data of, for example, a system as shown in FIG. 3A comprising an display array 30. In particular, FIG. 11A illustrates displaying an arbitrary portion of video data being received by the client device 7 at a rate of approximately 15 Hz, i.e., at a period of approximately 67 milliseconds between new frames of the video. The display is updated with a new Frame 1 at time $t_1$, and then Frame 1 is refreshed at a rate of approximately 60 Hz (a rate typically used in conventional displays). Accordingly, after the update of the new Frame 1, the conventional display refreshes Frame 1 approximately every 17 milliseconds. FIG. 11A illustrates that Frame 1 is updated at time $t_1$ and then refreshed three times at times $t_2$, $t_3$, and $t_4$. Then, the display array 30 is updated with a Frame 2 at time $t_5$. Frame 2 can be subsequently refreshed in the same manner as Frame 1.

As illustrated in FIG. 11B, a client device 7, for example, the embodiment of a client device shown in FIG. 3A, can employ a frame-skip refresh feature to optimize the use of the display array 30 by, for example, lowering the power requirements of the display array 30. As illustrated in FIG. 11B, the frame-skip refresh value is set to 1, and an update of Frame 1 occurs at time $t_1$. Approximately 17 milliseconds later at time $t_2$, when a conventional display would refresh this frame (as shown in FIG. 11A at time $t_2$), the refresh is skipped and displayed Frame 1 continues to be displayed (e.g., the display, or the relevant portion of the display if partitioned, does not change) so that the display array 30 can be said to be in a "hold" state. As the frame-skip refresh value has been set to 1 in this embodiment, at the next indicated refresh time $t_3$ the display array 30 is refreshed with Frame 1. Approximately 17 milliseconds later, at the next refresh time $t_4$, the currently displayed Frame 1 again continues to be displayed (e.g., in the "hold" state). At time $t_5$, the display array 30 is updated with the next frame, Frame 2, which can be refreshed and updated in a similar refresh-update process as done for Frame 1. Thus in this embodiment, the display process skips every other refresh procedure and, to a first order approximation, can effect a power and overhead savings of approximately one-half. In other embodiments, other frame-skip refresh values can be used, such as skip two, three, etc., frames, skip one then skip two, then skip one, etc., depending on the requirements of a particular application. Such a frame-skip refresh process is undesirable with conventional display technologies as the image quality seen by a viewer significantly degrades if refreshes are not performed in a timely manner (e.g., typically 60-75 Hz).

In another embodiment of reducing a display refresh rate to reduce power requirements, if a display device has a refresh rate that is higher than the frame rate of the display feed, the display array 30 can reduce the refresh rate to be equal to or less than the frame rate of the display feed. While reduction of the refresh rate is not possible on a typical display, such as a LCD display, a bi-stable display, such as a display array 30, can maintain the state of the pixel element for a longer period of time and, thus, may reduce the refresh rate when necessary. As an example, if a video stream being displayed on a PDA has a frame rate of 15 Hz and the bi-stable PDA display is capable of refreshing at a rate of 60 times per second (having a refresh rate of 1/60 sec=16.67 ms), then a typical bi-stable display may update the display with each frame of video data up to four times. For example, a 15 Hz frame rate updates every 66.67 ms. For a bi-stable display having a refresh rate of 16.67 ms, each frame may be displayed on the display device up to 66.67 ms/16.67 ms=4 times. However, each refresh of the display device requires some power and, thus, power may be reduced by reducing the number of updates to the display device. With respect to the above example, when a bi-stable display device is used, up to 3 refreshes per video frame may be removed without affecting the output display. More particularly, because both the on and off states of pixels in a bi-stable display may be maintained without refreshing the pixels, a frame of video data from the video stream need only be rendered on the display device once, and then maintained until a new video frame is ready for display. Accordingly, a bi-stable display may reduce power requirements by rendering each video frame only once.

In one embodiment, frames of a video stream are skipped, based on a programmable "frame skip count." Referring to FIG. 3A, in one embodiment of a bi-stable display, a display driver, such as array driver 22, is programmed to skip a number of refreshes that are available to the bi-stable display, the interferometric modulator display array 30. In one embodiment, a register in the array driver 22 stores a value, such as 0, 1, 2, 3, 4, etc, that represents a frame skip count. The driver may then access this register in order to determine the frequency of refreshing the display array 30. For example, the values 0, 1, 2, 3, and 4, may indicate that the driver updates the display array 30 every frame, every other frame, every third frame, every fourth frame, and every fifth frame, respectively. In one embodiment, this register is programmable through a communication bus (of either parallel or serial type) or a direct serial link, such as via a SPI. In another embodiment, the register is programmable from a direct connection with a controller, such as the driver controller 29. Also, to eliminate the need for any serial or parallel communication channel beyond the high-speed data transmission link described above, the register programming information can be embedded within the data transmission stream at the controller and extracted from that stream at the driver.

Figure 12:
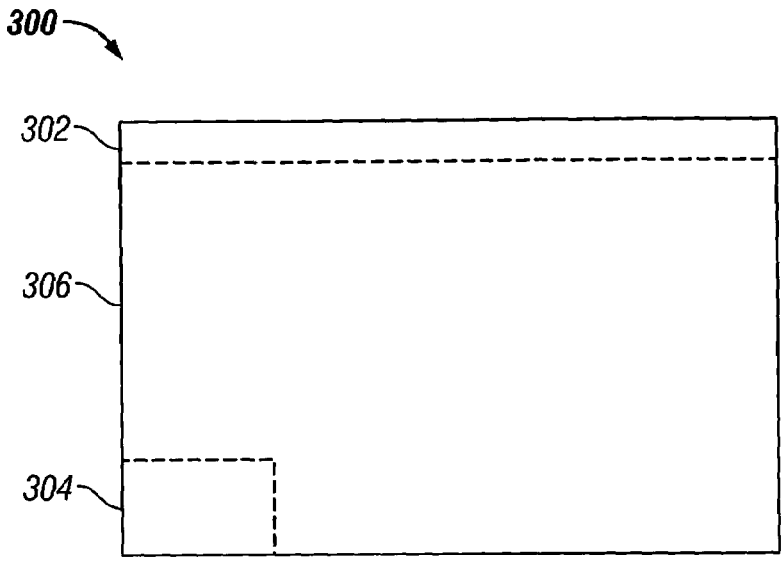
FIG. 12 illustrates a plan view of one embodiment of an interferometric modulator display 300 that is partitioned into three fields.

Another display mode or feature that can be selected by the process 200 includes an area address or display partitioning mode. As previously described, as the display array 30 does not require the constant frequent refreshing of conventional displays, the display array 30 can be partitioned into two or more areas. Using area addressing, each area or partition can be updated separately, for example, one partition of the display array 30 that displays infrequently changing data can be updated infrequently, and another partition of the display array 30 that displays frequently changing data can have a corresponding frequent update rate. For example, FIG. 12 illustrates, in plan view from the perspective of a viewer, one embodiment of an interferometric modulator display 300, which is similar to the display array 30 shown in FIG. 3A, but the interferometric modulator display 300 (FIG. 12) has been partitioned into a first field 302, a second field 304, and a third field 306, according to this embodiment. In these embodiments, the different fields of the interferometric modulator display 300, such as the first, second and third fields, 302, 304, 306, may be treated in a separate and different manner with respect to updating images displayed in the different fields 302, 304, 306 depending upon the nature of the images which are displayed in the respective fields 302, 304, 306.

For example, in one embodiment, the first field 302 can display a toolbar having multiple icons corresponding to different operational features which a device, including the interferometric modulator display 300, can provide. It will be appreciated following a consideration of the description of the various embodiments, that the interferometric modulator display 300 can be incorporated into a variety of electronic devices including, but not limited to, cellular telephones, personal digital assistants (PDAs), text messaging devices, calculators, portable measurement or medical devices, video players, personal computers, and the like. Thus, in one embodiment the first field 302 can portray images corresponding to a toolbar having a plurality of icons which, during use, retain a constant configuration and location with respect to the interferometric modulator display 300, except perhaps a change of the coloration or highlighting of a particular icon in the first field 302 upon selection of the corresponding function. Thus, images displayed in the first field 302 of the interferometric modulator display 300, would typically require relatively infrequent updating or no updating in particular applications.

A second field 304 can correspond to a region of the interferometric modulator display 300 having significantly different upgrade demands than images portrayed in the first field 302. For example, the second field 304 may correspond to a series of video images which are portrayed on the interferometric modulator display 300 indicating a much higher update rate, such as at approximately 15 Hz corresponding to a video stream. Thus, the update requirements for images portrayed in the first field 302 could be of an infrequent aperiodic nature, such as substantially no updating during use if the image is constant or relatively infrequent aperiodic updating when, for example, a user selects an icon to activate a corresponding operational feature of a device incorporating the interferometric modulator display 300. However, the update requirements for images in the second field 304, would be of a generally periodic nature corresponding to the periodic framing of video data displayed in the second field 304, however, the updating of images displayed in the second field 304 can be readily conducted in an asynchronous manner with respect to updates provided for images in the first field 302. Furthermore, the fields may be overlapping, i.e., one field is designated as being on top of the other and covers the overlapped portion of the underlying field.

Images displayed in the third field 306 can have yet other update requirements different from those of either the first field 302 or the second field 304. For example, in one embodiment, the data displayed in the third field 306 can comprise text, such as e-mail or news content, through which a user of the device may periodically scroll. In such an embodiment, frequent updating of the data in the third field 306 can be necessary corresponding to the users' viewing requirements, for example, during scrolling. However, typically there can also be relatively long periods during which the same image is constantly displayed in the third field 306 as the user reads the information displayed. During these periods, no updating of the display is necessary. Accordingly, the display 300 can support update characteristics which are significantly time varying, for example, periods of substantially no updating while the displayed image is static and periods of relatively high updating when the image is changing. It will also be appreciated that the updating of the images displayed in the third field 306 can also be performed in an asynchronous manner with respect to the updating of data in the first and second fields 302, 304.

In certain embodiments, the interferometric modulator display 300 can also provide different update schemes in addition to different update rates. For example, the first field 302 can be updated in a similar manner to the progressive scan type drive schemes. The second field 304 could be driven with waveforms similar to those used for the first field 302, however in an interlaced row scan manner to reduce power consumption. Yet another embodiment is to drive the third field 306 in a pixel at a time. This embodiment can be advantageously employed when successive frames of data exhibit a relatively high degree of frame to frame correlation. Thus the update can be limited to those pixels changing states. Partitioning of an interferometric modulator display is further described in the aforementioned related Application No. 60/613,573, titled "System Having Different Update Rates For Different Portions Of A Partitioned Display."

Another display mode or feature that can be selected by the process 200 includes addressing individual pixels or groups of pixels, referred to herein as "pixel addressing." As previously described above, an advantageous feature of an display array 30 is that it does not require the constant refreshing of its display, as do conventional displays. In one embodiment of pixel addressing, the process 200 can perform the above-described rip-and-hold functionality and display an image on the interferometric modulator display 30. Then, the process 300 can dynamically evaluate incoming data, and determine a change vector corresponding to those particular pixels which change between subsequent frames, and address and update only those pixels which are changing while holding the remainder at their previously set state. Thus, for example when the display array 30 is portraying a relatively constant background with a pointer or cursor moving across the displayed image, only a relatively small proportion of the overall displayed image needs to be updated (e.g., the pixels corresponding to the movement of the cursor), again significantly reducing the system overhead and power expenditure consumed by the client device 7.

Figure 13A:
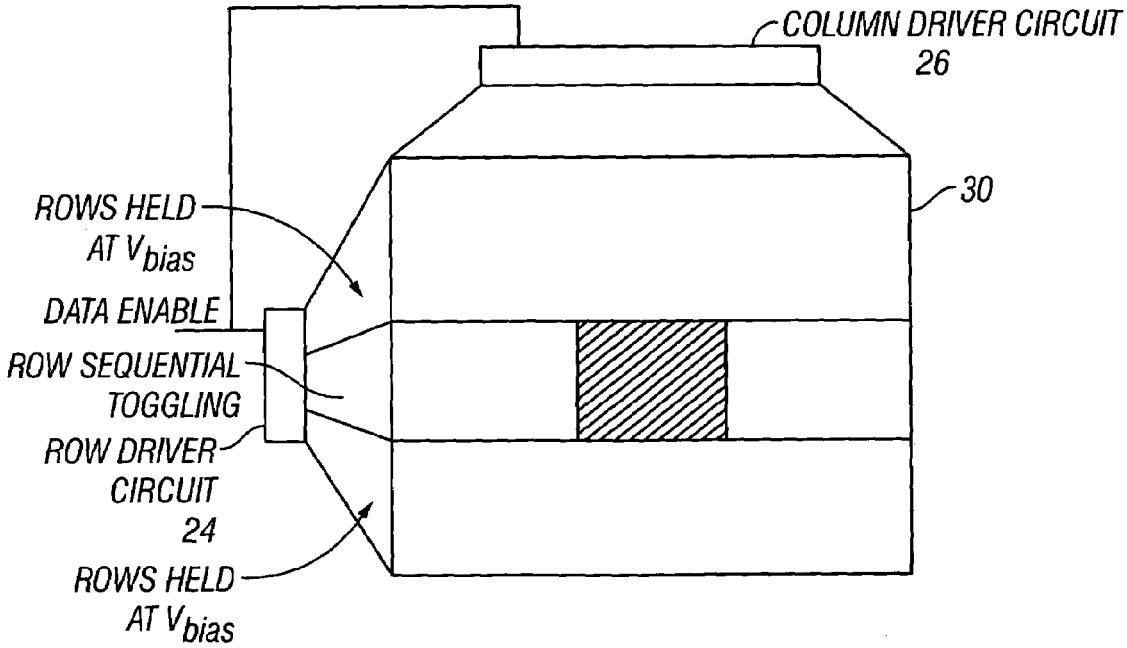
FIG. 13A is a schematic diagram illustrating an array driver that is configured to use an area update optimization process.

FIG. 13A is a schematic diagram illustrating an array driver, such as the array driver 22 shown in FIG. 3A, that is configured to use an area update optimization process. As an exemplary embodiment, the circuitry referred to here is shown in FIG. 3A. The array driver 22 includes a row driver circuit 24 and a column driver circuit 26. In the embodiment shown in FIG. 13A, circuitry is embedded in an array driver 22 to use a signal that is included in the output signal set of a driver controller 29 to delineate the active area of the display array 30 being addressed. The signal to delineate the active area is typically designated as a display enable. The active area of the display array 30 can be determined via register settings in the driver controller 29 and can be changed by the processor 21 (FIG. 3A). The circuitry embedded in the array driver 22 can monitor the display enable signal and use it to selectively address portions of the display. Typically display video interfaces in addition utilize a line pulse or a horizontal synchronization signal, which indicates the beginning of a line of data. A circuit which counts line pulses can determine the vertical position of the current row. When the refresh signals are conditioned upon receiving a display enable from the processor 21 (signaling for a horizontal region), and upon the line pulse counter circuit (signaling for a vertical region) an area update function can be implemented. The signal the row driver circuit 24 asserts, for example, $-\Delta V$, 0, or $+\Delta V$ voltage levels, is determined by the value of a line pulse counter and when display enable is enabled. For a particular row, if a line pulse is received and the display enable signal is not active, the row is set at the same voltage level it is currently at, but a counter is incremented. When the display enable signal is active and the line pulse is received, the row driver circuit 24 asserts the desired voltage level on the row. If the line pulse counter indicates that the row is in an area of the display to be updated, it asserts the desired signal on the row. Otherwise, no signal is asserted.

Figure 13B:
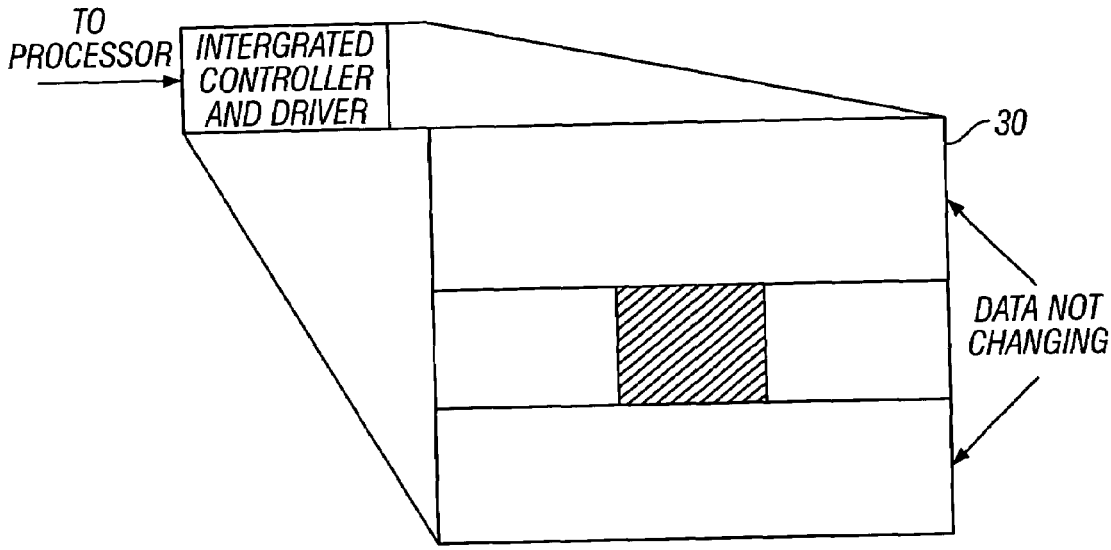
FIG. 13B is a schematic diagram illustrating a controller that can be integrated with an array driver.

FIG. 13B is a schematic diagram illustrating a controller that can be integrated with an array driver. In the embodiment shown in FIG. 13B, a driver controller is integrated with an array driver. Specialized circuitry within the integrated driver controller and driver first determines which pixels and hence rows require refresh, and only selects and updates those rows that have pixels that have changed. With such circuitry, particular rows can be addressed in non-sequential order, on a changing basis depending on image content. This embodiment is advantageous because only the changed video data needs to be communicated through the interface between the integrated controller and driver circuitry and the array driver circuitry refresh rates can be reduced between the processor and the display array 30. Lowering the effective refresh rate required between processor and display controller lowers power consumption, improves noise immunity and reduces electromagnetic interference issues for the system.

Figure 14:
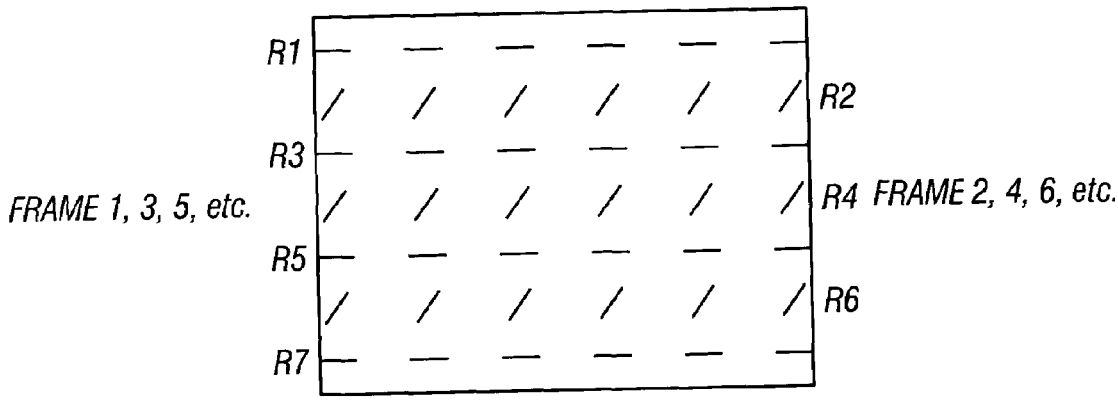
FIG. 14 illustrates one embodiment of a display system providing the ability to directly process interleaved data streams.

Another display mode that can be advantageously implemented on a bi-stable display is an interlacing mode of displaying video data. In some embodiments, the bi-stable array can be the display array 30. In some embodiments, video data is coded in an interlaced manner for compatibility with existing display technologies, such as the CRTs of conventional televisions. Typically, interlacing refers to a video data display methodology where a conventional display is updated or refreshed by alternately writing all the odd rows of a display for a first frame, and then in the next successive frame, writing all the even number rows for the next frame. For example, as illustrated in FIG. 14, for video data frames 1-6, the odd rows R1, R3, R5, and R7, etc., are written for frames 1, 3, and 5, and the even rows R2, R4, R6, etc., are written for frames 2, 4, and 6. Thus, in an interlaced format alternating halves of the total display matrix are refreshed or updated in an alternating manner such that for example each odd or even row is updated or refreshed every other cycle. Because of the relatively frequent constant refreshing required with conventional displays, in many applications this raw interlaced data is processed into what is known as a progressive format merging the interlaced video data in an interpolative manner.

In contrast, because the bi-stable display, for example, the interferometric modulator display 30, does not require constant frequent refreshing the process 200 can directly support interlaced data and the display array 30 itself maintains a previous frame of data throughout the refreshing of the interleaved data set.

Figure 15:
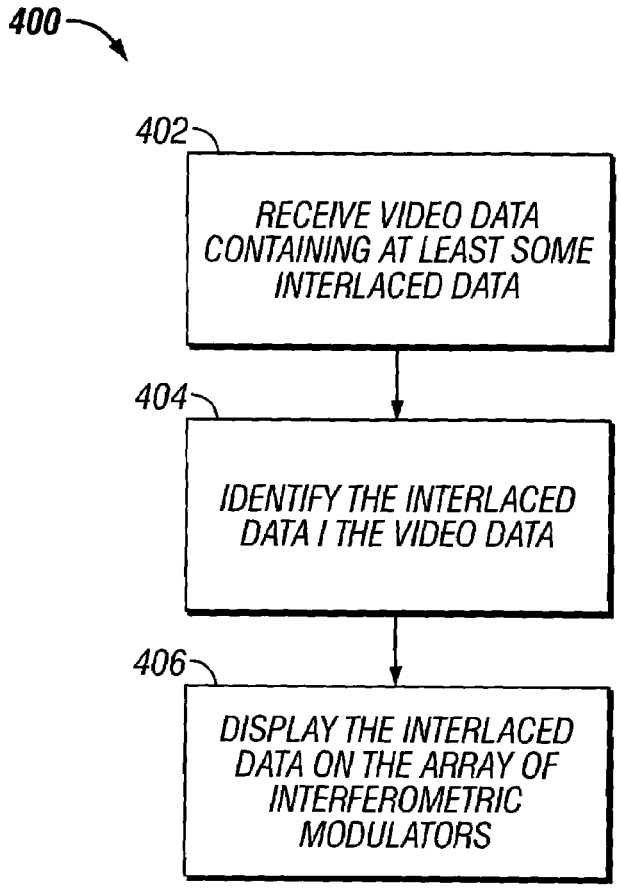
FIG. 15 illustrates a process for displaying interlaced data on an array of interferometric modulators.
Figure 16:
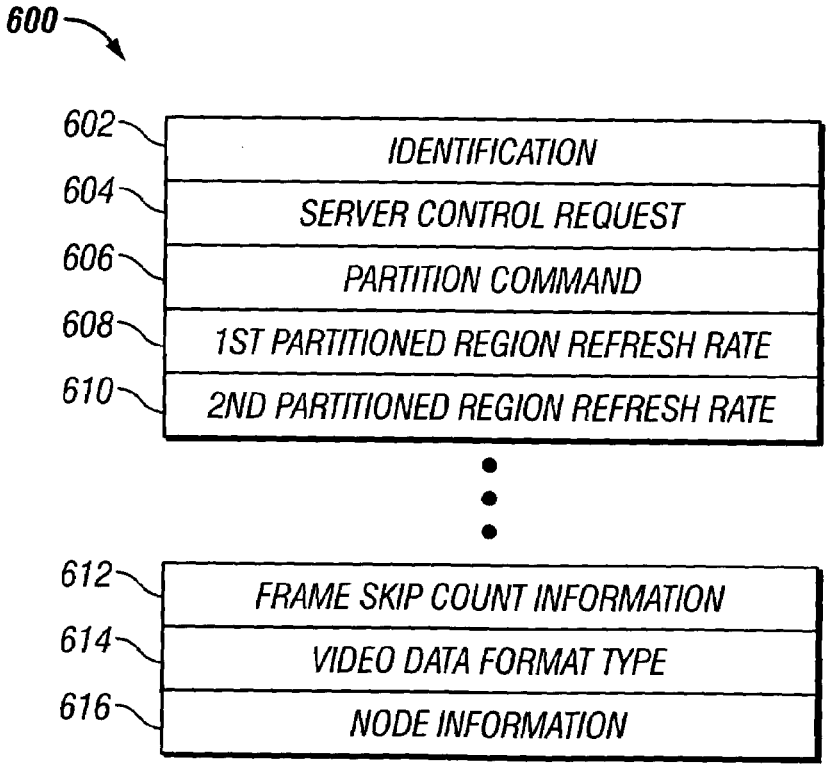
FIG. 16 illustrates one example of a server-provided message.

FIG. 15 further illustrates displaying interlaced data on a display comprising an array of interferometric modulators. In FIG. 15, a process 400 runs on a client device 7 for example, the client device 7 shown in FIG. 1, to display interlaced data from a server 2. In state 402, the client device 7 receives video data containing at least some interlaced data from the server 2. There are various ways that the interlaced data can be identified to the client device 7. In one embodiment, interlaced data information is sent to the client device 7 as part of the server control information describing the video data and its contents. For example, FIG. 16 illustrates one embodiment of a server-provided message control information that includes identifying information for the interlaced video data, and other display information. The server-provided message 600 can include content such as a video data format type 614 which can be used by the server 2 to inform the client device 7 that the server 2 is providing interlaced video data to the client device 7. In state 404, the client device 7 identifies the interlaced data in the video data using server control information, such as shown in FIG. 16.

Referring now to FIG. 16, in some embodiments, the server-provided message 600 can also include other information related to displaying video data on the client device 7. In the embodiment shown in FIG. 16, the message 600 includes an identification segment 602 that identifies the type of content being sent to the client device 7. For example, if the content is a phone call, the caller's phone number may be provided. If the content is a media from a web-site, an indicia of the identity of the web-site may be provided via the identification segment 602. The server control request 604 is a request from the server for the client to grant the server control over its display and refresh and/or update rates. The partition command 606 includes the instructions to the client as to how its display (not shown) is to be partitioned. The partition command 606 may include rows or columns of the display indicating partitioned regions of the display. The first partition refresh rate value 608 indicates the rate at which content displayed in the display's first partition is updated or refreshed, and the second partition refresh rate value 610 indicates the rate at which the content displayed in the display's second partition is updated or refreshed. In some embodiments, the server message 600 also includes frame skip count information 612, video data format type 614 and/or other information such as node information 616. The frame skip count information 612 can be used to determine whether to display a frame of video data, as discussed hereinabove. The video data format type 614 can be used by the server 2 to indicate to the client device 7 what type if data is being sent from the server 2, for example, interlaced data. The node information 616 in the message can be used to indicate to the client device 7 node or network device information relating to the data being sent from the server 2.

The process 400 then continues to state 406, where the process 200 displays the interlaced data on a display array 30, as described above. Depending on the embodiment, states of FIG. 15 can be removed, added, or rearranged.

Accordingly, the process 200 utilized with a client device 7 having an interferometric modulator display can provide significant additional flexibility and bandwidth savings to users. Additionally, again referring to FIG. 1, the server 2 can readily determine the appropriateness and efficacy of these various operating modes or features and select one or more as desired to either increase the functionality to the end user and/or reduce the bandwidth and power consumed to provide comparable functionality to a given client device 7 thus increasing the availability of services to further client devices 7. Embodiments of the invention provide a display system wherein the server 2 can determine the characteristics of a client device display and enable one or more display features or modes of the display. In another embodiment, the client device 7 is configured to selectively enable one or more display features or modes in accordance with the characteristics of data to be displayed on the display. A link 8 between the client device 7 and server 2 is, in certain embodiments, at least partially a bi-directional link. This provides the advantage that the client device 7 can inform or provide data indicative of the characteristics of the client device 7 to the server 2. Thus, in certain embodiments, the server 2 may be in communication via a plurality of links 8 with a plurality of client devices 7 and the plurality of client devices 7 can include devices having conventional displays and operating under the constraint thereof as previously described as well as one or more client devices 7 including one or more interferometric modulator displays 30 offering the operational advantages described herein. Thus, the server 2 can be informed in an interactive manner as to the nature of the client device 2 thereby enabling the system 1 to improve the operation both of the server 2 as well as the plurality of client devices 7 enabling the system 1 to exploit the advantages of interferometric modulator displays in a dynamic manner.

While the above detailed description has shown, described, and pointed out novel features of the invention as applied to various embodiments, it will be understood that various omissions, substitutions, and changes in the form and details of the device or process illustrated may be made by those skilled in the art without departing from the spirit of the invention. As will be recognized, the present invention may be embodied within a form that does not provide all of the features and benefits set forth herein, as some features may be used or practiced separately from others.

The invention claimed is:

1. A method of displaying information on a display, the method comprising:

receiving video data at a device having an interlaced mode of displaying data and a non-interlaced mode of displaying data;

identifying a portion of the video data as interlaced data; and displaying the interlaced data on the display, the display comprising an array of interferometric modulators, wherein an update rate of the interlaced data is determined using a frame skip count.

2. An electronic device, comprising:

an array of interferometric modulators; and an array driver for the array of interferometric modulators, the array driver configured to receive video data which includes data in an interlaced format, to identify a portion of the video data that is in interlaced format, and to render the identified video data in an interlaced format, wherein the array driver selectively skips selected frames based upon a frame skip count.

3. An electronic device, comprising:

an array of interferometric modulators; and an array driver for the array of interferometric modulators, the array driver configured to display, depending on a selected mode, interlaced and non-interlaced video data, wherein the array driver selectively skips selected frames based upon a frame skip count.

4. A method of displaying information on a display having an array of interferometric modulators, comprising:

determining at a server the characteristics of the display of a client device;

selecting one or more display modes for the display of the client device based on the characteristics of the display;

receiving video data at the client device over a communications network; and displaying the video data on the display using one or more of the selected display modes, wherein a selected display mode is rip and hold.

5. A method of displaying information on a display having an array of interferometric modulators, comprising:

determining at a server the characteristics of the display of a client device;

selecting one or more display modes for the display of the client device based on the characteristics of the display;

receiving video data at the client device over a communications network; and displaying the video data on the display using one or more of the selected display modes, wherein a selected display mode is frame skip count.

6. A method of displaying information on a display having an array of interferometric modulators, comprising:

determining at a server the characteristics of the display of a client device;

selecting one or more display modes for the display of the client device based on the characteristics of the display;

receiving video data at the client device over a communications network;

displaying the video data on the display using one or more of the selected display modes; and partitioning the display into two or more regions and updating each region at its own update rate.

* * * * *